US008958726B2

(12) United States Patent
Matsunaga et al.

(10) Patent No.: US 8,958,726 B2
(45) Date of Patent: Feb. 17, 2015

(54) DEVELOPER ACCOMMODATING CONTAINER, PROCESS CARTRIDGE AND ELECTROPHOTOGRAPHIC IMAGE FORMING APPARATUS

(71) Applicant: Canon Kabushiki Kaisha, Tokyo (JP)

(72) Inventors: Tomonori Matsunaga, Suntou-gun (JP); Go Shindo, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/899,945

(22) Filed: May 22, 2013

(65) Prior Publication Data

US 2013/0322926 A1 Dec. 5, 2013

(30) Foreign Application Priority Data

May 30, 2012 (JP) ..... 2012-123634

(51) Int. Cl.
*G03G 15/08* (2006.01)

(52) U.S. Cl.
CPC ..... *G03G 15/0896* (2013.01); *G03G 15/0874* (2013.01)
USPC ..... 399/258

(58) Field of Classification Search
USPC ..... 399/258, 261, 263
See application file for complete search history.

(56) References Cited

U.S. PATENT DOCUMENTS 4,766,457 A * 8/1988 Barker et al. ..... 399/106
6,836,639 B2 12/2004 Karakama et al.
2013/0164040 A1 6/2013 Matsushita et al.

FOREIGN PATENT DOCUMENTS

JP 04-066980 3/1992

OTHER PUBLICATIONS

Office Action in Chinese Patent Application No. 201110147065.5, dated Aug. 2, 2013 (with English-language translation).

* cited by examiner

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

A developer accommodating unit includes: a flexible container, provided with an opening for permitting discharge of a developer, for accommodating the developer; a frame for accommodating the flexible container and for accommodating the developer discharged from the flexible container; and an urging member, provided inside the frame, for urging the flexible container to deform the flexible container. The flexible container has a plurality of sides, where the developer accommodated inside the flexible container receives gravitation, defined by a bent portion. The sides are capable of receiving an urging force of the urging member.

16 Claims, 32 Drawing Sheets

(a)

(b)

(a)

(b)

(a)

(b)

(a)

(b)

(a)

(b)

(a)

(b)

(a)

(b)

(a)

(b)

(a)

(b)

DEVELOPER ACCOMMODATING CONTAINER, PROCESS CARTRIDGE AND ELECTROPHOTOGRAPHIC IMAGE FORMING APPARATUS

FIELD OF THE INVENTION AND RELATED ART

The present invention relates to a developer accommodating unit for use with an image forming apparatus, a process cartridge including the developer accommodating unit, and an electrophotographic image forming apparatus in which these members are incorporated.

The image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine, and the like.

Further, the process cartridge refers to a cartridge, prepared by integrally assembling at least a developing means and a developing device, detachably mountable to a main assembly of the image forming apparatus and refers to a cartridge, prepared by integrally assembling the developing device and a photosensitive member unit including at least a photosensitive member, detachably mountable to the main assembly of the image forming apparatus.

Further, a developer accommodating container and the developer accommodating unit are accommodated in the image forming apparatus or the process cartridge. The developer accommodating unit container and the developer accommodating unit at least include a flexible container for accommodating the developer.

In a conventional electrophotographic image forming apparatus using the electrophotographic image forming process, a process cartridge type in which an electrophotographic photosensitive member and process means acting on the photosensitive member are integrally assembled into a cartridge and this cartridge is detachably mountable to a main assembly of the electrophotographic image forming apparatus is employed.

In such a process cartridge, as shown in FIG. 20, an opening provided to a developer accommodating frame 34 for accommodating a developer (toner, carrier, etc.) is sealed with a sealing member. Further, a type in which a bonding portion 33 of a toner seal 32 as a sealing member is peeled off at the time of use to unseal the opening, thus enabling feeding (supply) of the developer has been widely employed (Japanese Laid-Open Patent Application (JP-A) Hei 04-66980, FIG. 13).

Further, in order to solve a problem such that the developer is scattered in the process cartridge in a developer filling step during manufacturing of the process cartridge, a constitution in which a deformable inside container is used has been devised (JP-A Hei 04-66980).

In the conventional technique, for the purpose of improving operativity of the developer feeding and of reducing a cost of a developer feeding device by preventing the scattering of the developer in the process cartridge, a method of accommodating the developer in the deformable inside container (flexible container) is described. However, in this method, operation and mechanism relating to discharge of the developer after the unsealing are not described.

Further, in the case where the deformable inside container was used inside the cartridge, the following deformation was generated in a bottom side, with respect to a vertical direction, where powder pressure of a filled developer is applied. For example, in a constitution in which the deformable inside container is hung, by self-weight of the filled developer, the inside container is flexed in the (downward) vertical direction. In this case, when a rotatable member such as a feeding member for feeding the developer is provided in the neighborhood of the bottom of the inside container, a position relationship between the rotatable member and the inside container is, even when it is a non-contact state at an initial stage, a contact state when a degree of flexure is increased. For that reason, there was a possibility that an excessive torque was generated in the rotatable member and thus a stopping motor of the image forming apparatus caused loss of synchronism. In order to avoid the contact between the rotatable member and the inside container, there is a need to design, in consideration of an estimated maximum flexure amount, the positional relationship so as to space the rotatable member and the inside container. For this reason, there was a possibility that the process cartridge was increased in size.

SUMMARY OF THE INVENTION

A principal object of the present invention is to provide a developer accommodating unit capable of increasing strength of a flexible container at a portion, where powder pressure of a developer is applied, to reduce a degree of flexure of the flexible container and thus capable of compatibly realizing downsizing of a developing device and improvement in efficiency of discharge of the developer from the flexible container.

According to an aspect of the present invention, there is provided a developer accommodating unit comprising: a flexible container, provided with an opening for permitting discharge of a developer, for accommodating the developer; a frame for accommodating the flexible container and for accommodating the developer discharged from the flexible container; and an urging member, provided inside the frame, for urging the flexible container to deform the flexible container, wherein the flexible container has a plurality of sides, where the developer accommodated inside the flexible container receives gravitation, defined by a bent portion, and wherein the sides are capable of receiving an urging force of the urging member.

These and other objects, features and advantages of the present invention will become more apparent upon a consideration of the following description of the preferred embodiments of the present invention taken in conjunction with the accompanying drawings.

Figure 3:
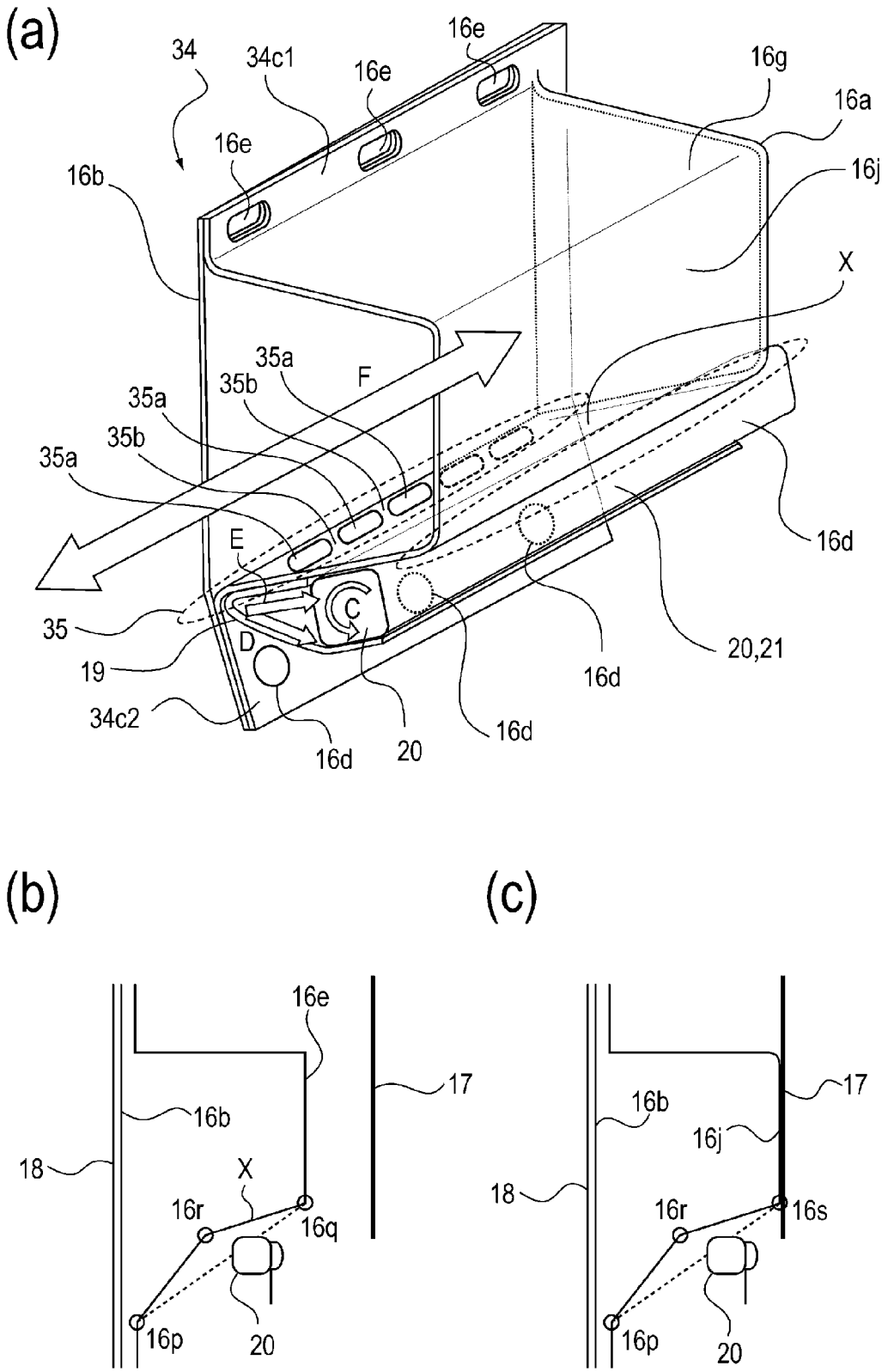

Parts (a) to (c) of FIG. 3 are schematic views showing a structure of a flexible container.

Figure 4:
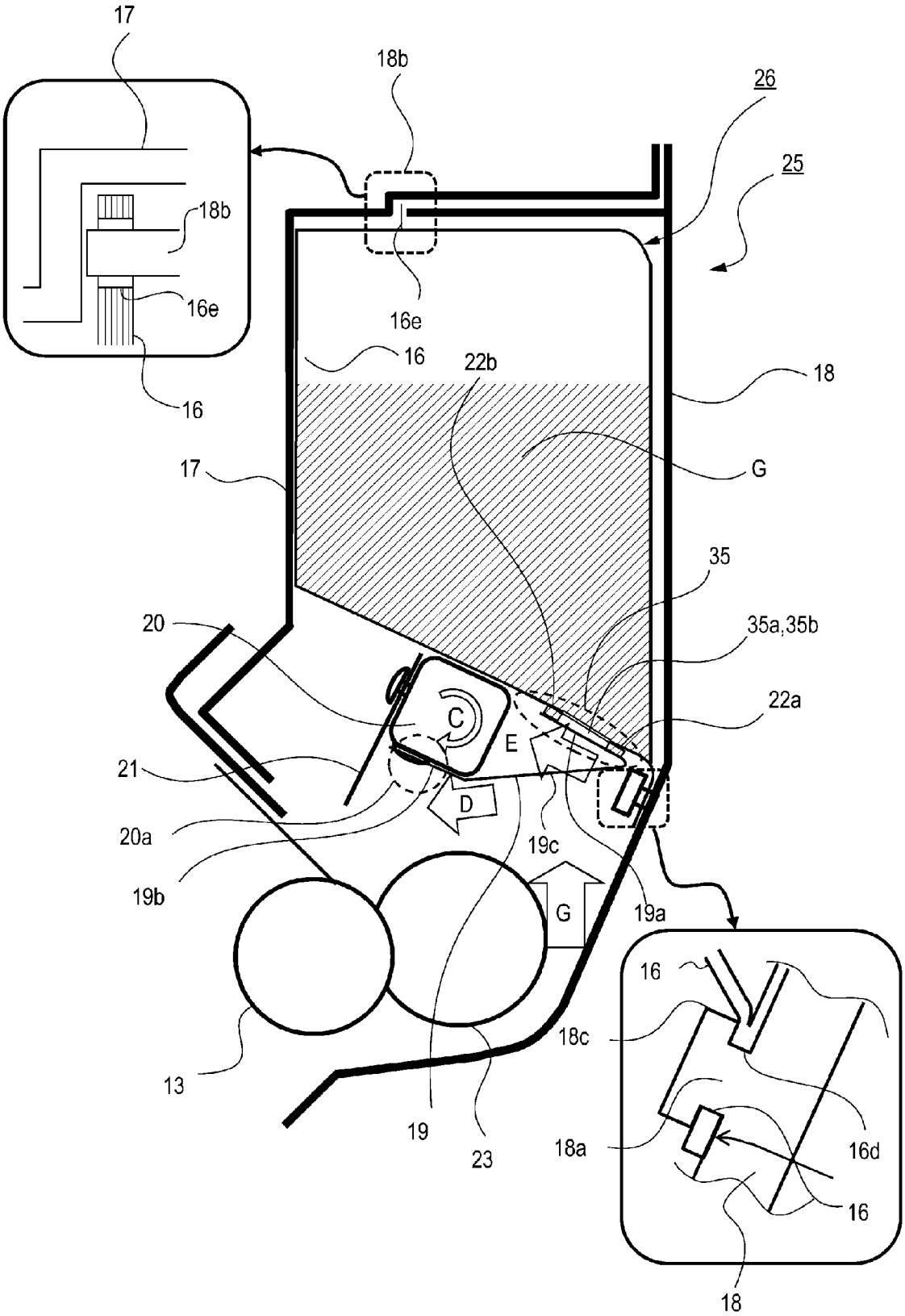

FIG. 4 is a sectional view showing an inside structure of a frame.

Figure 5:
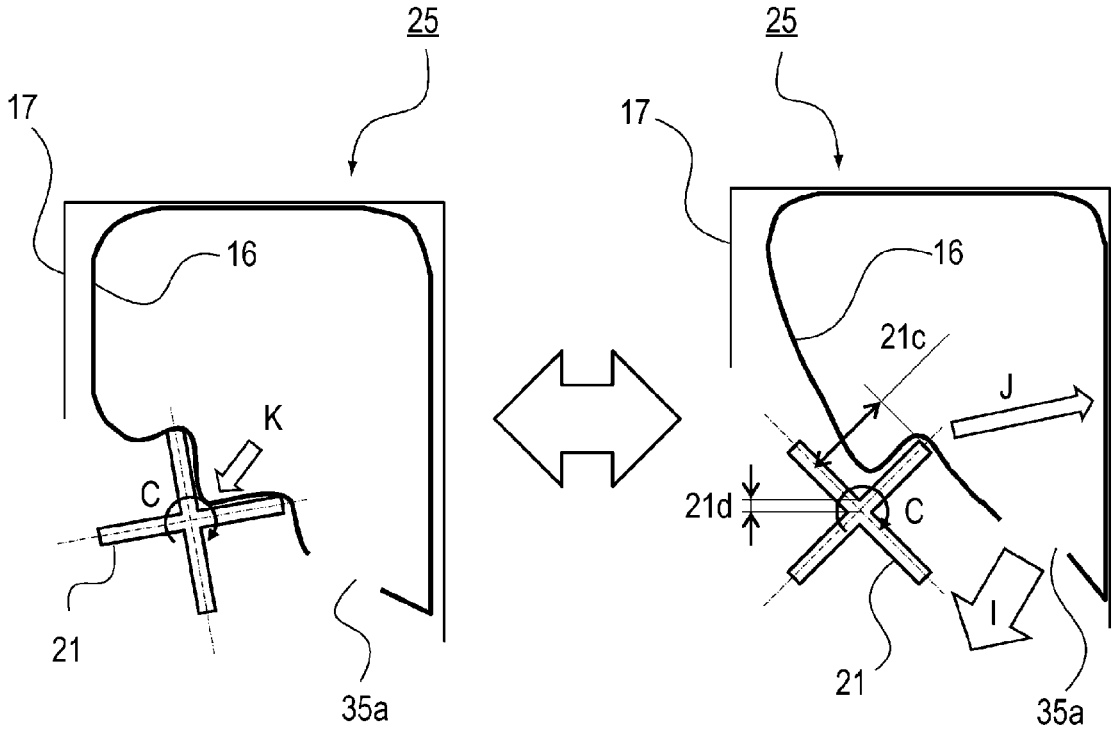
Figure 5:
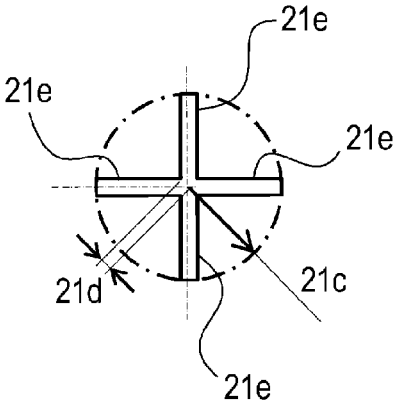

Parts (a) and (b) of FIG. 5 are sectional views showing a structure (another structure) of an urging member.

Figure 6:
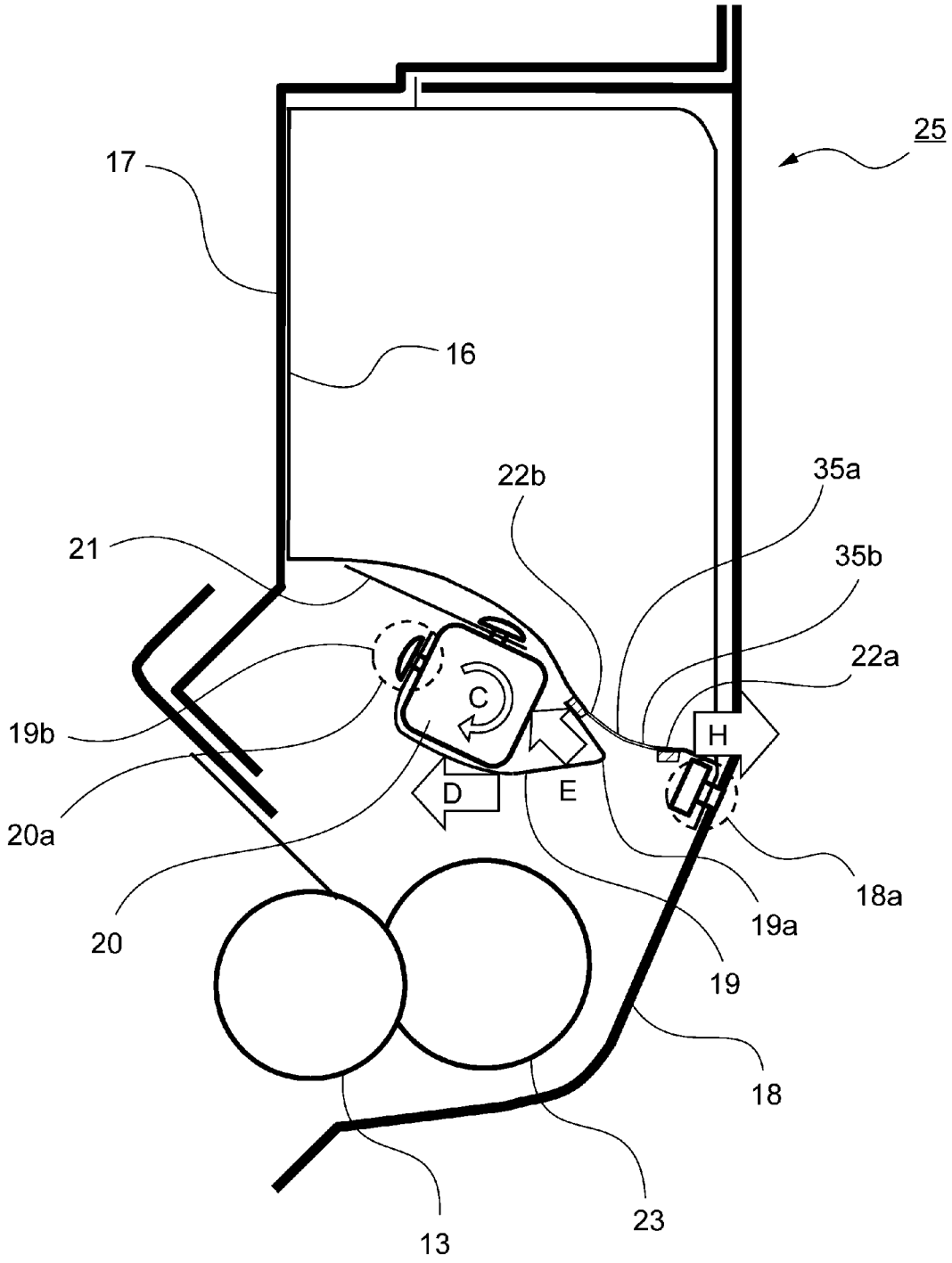

FIG. 6 is a sectional view for illustrating an operation in the inside of the frame.

Figure 7:
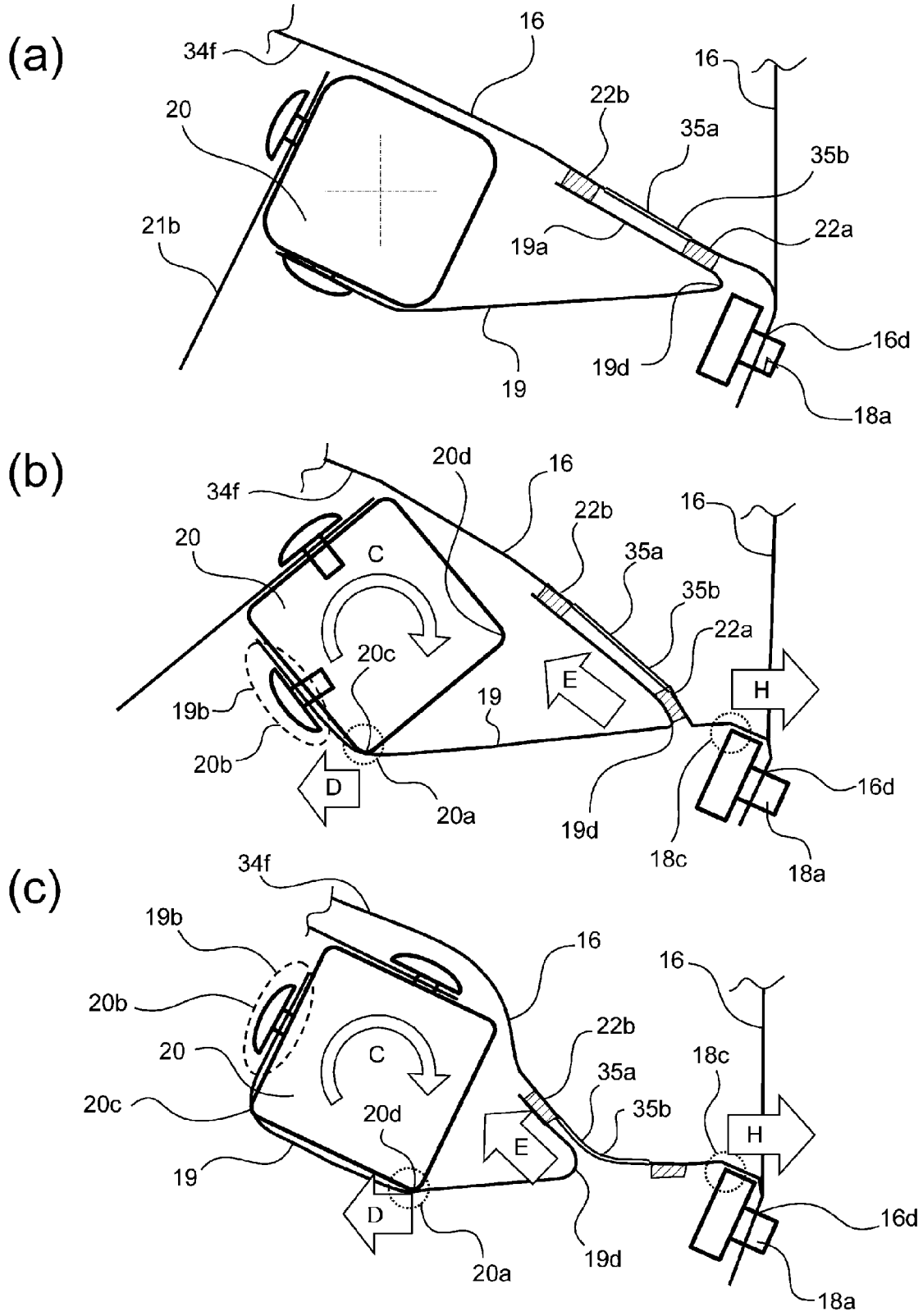
Figure 8:
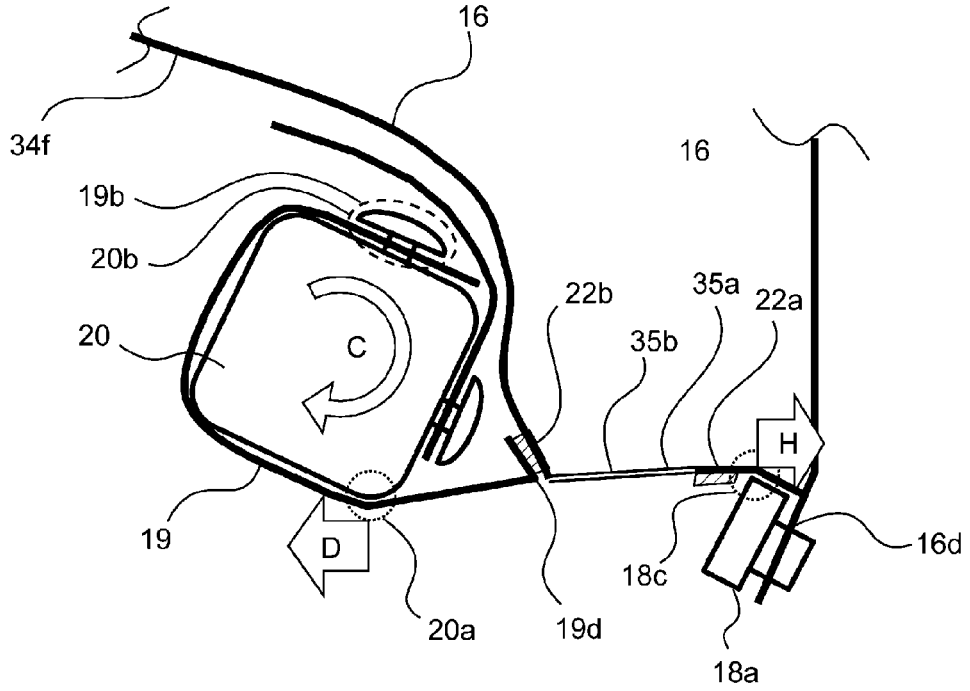
Figure 8:
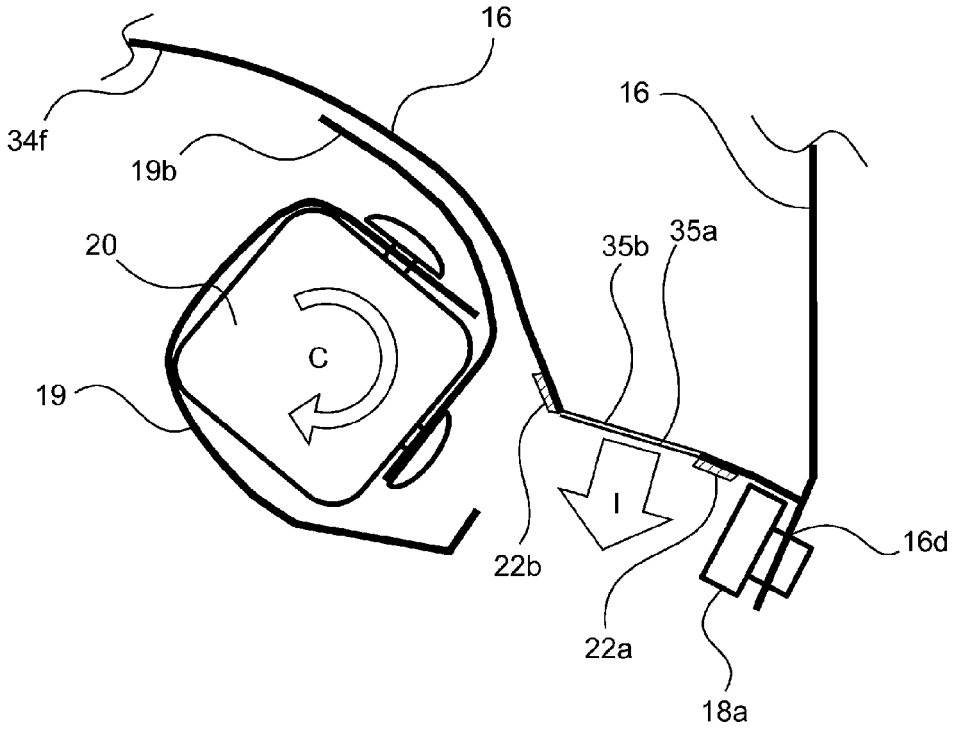
Figure 9:
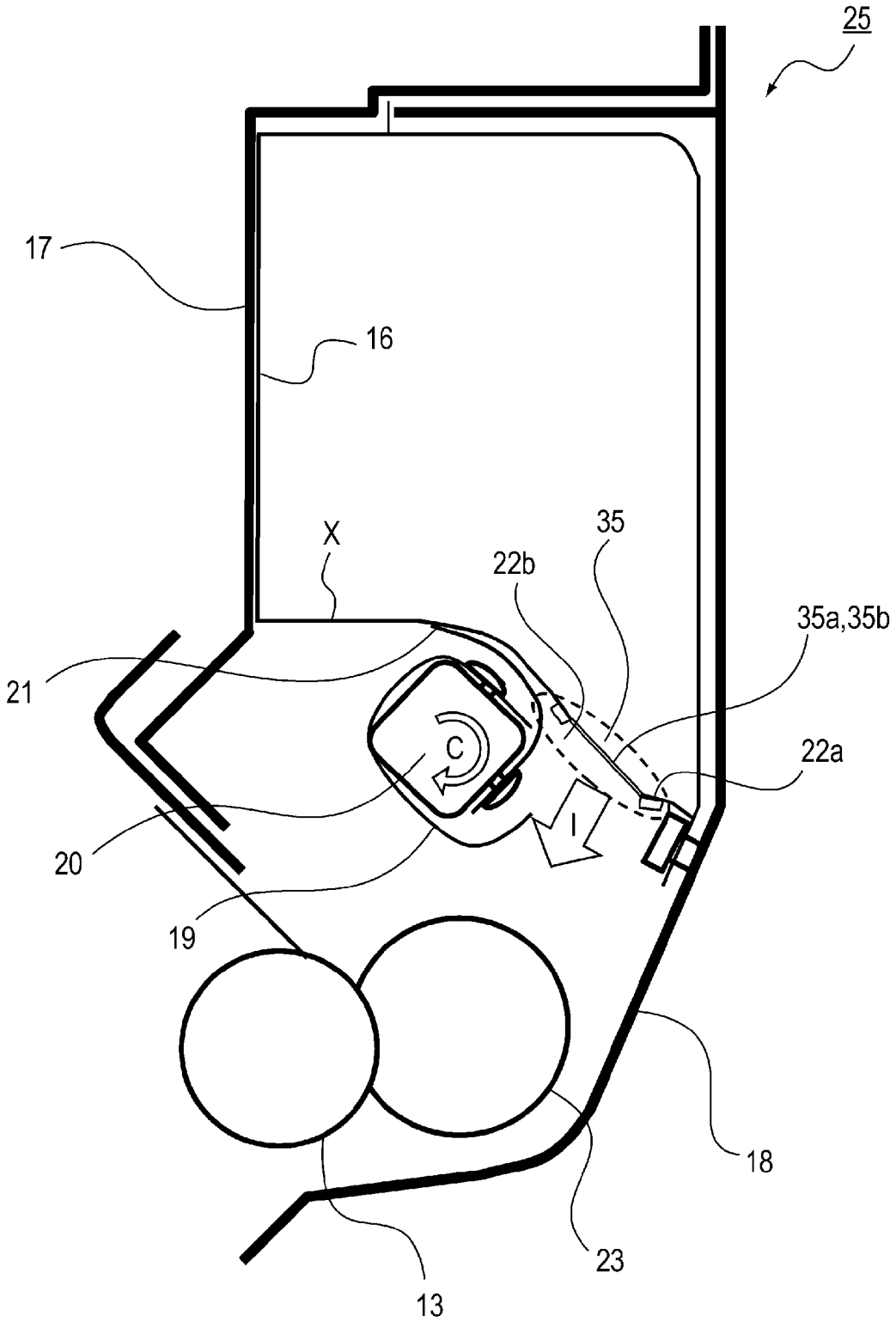

Parts (a) to (c) of FIG. 7, (a) and (b) of FIG. 8, and FIG. 9 are sectional views for illustrating an operation of a sealing member.

Figure 10:
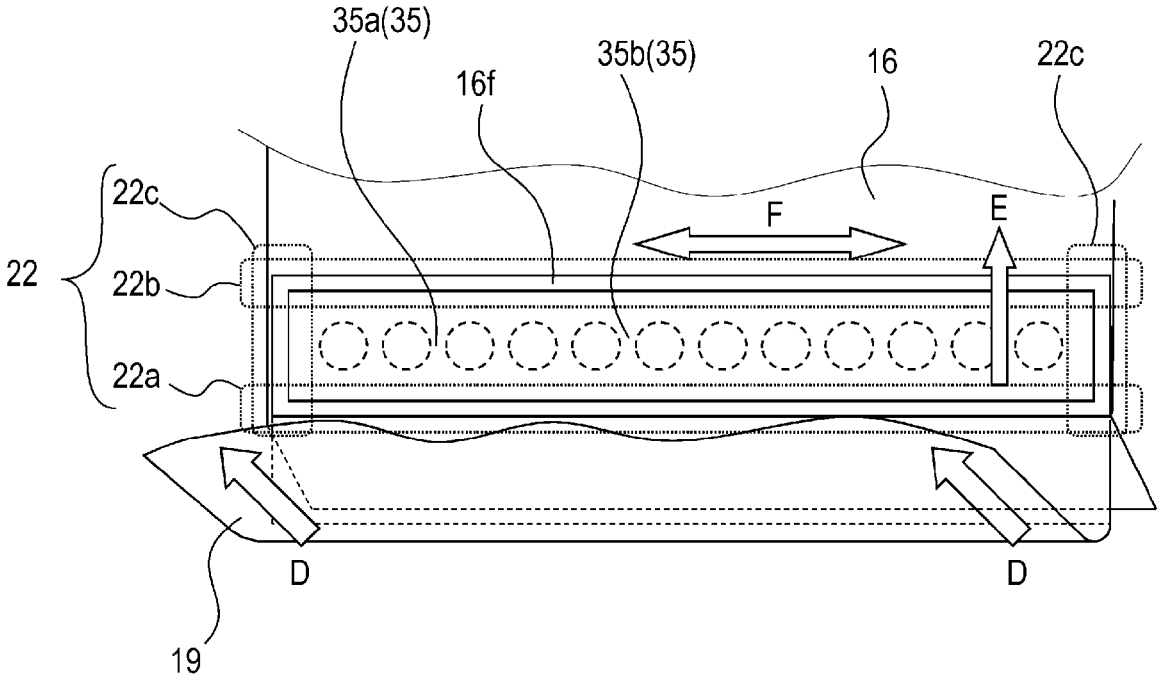

FIG. 10 is a plan view showing a structure of a discharging portion.

Figure 11:
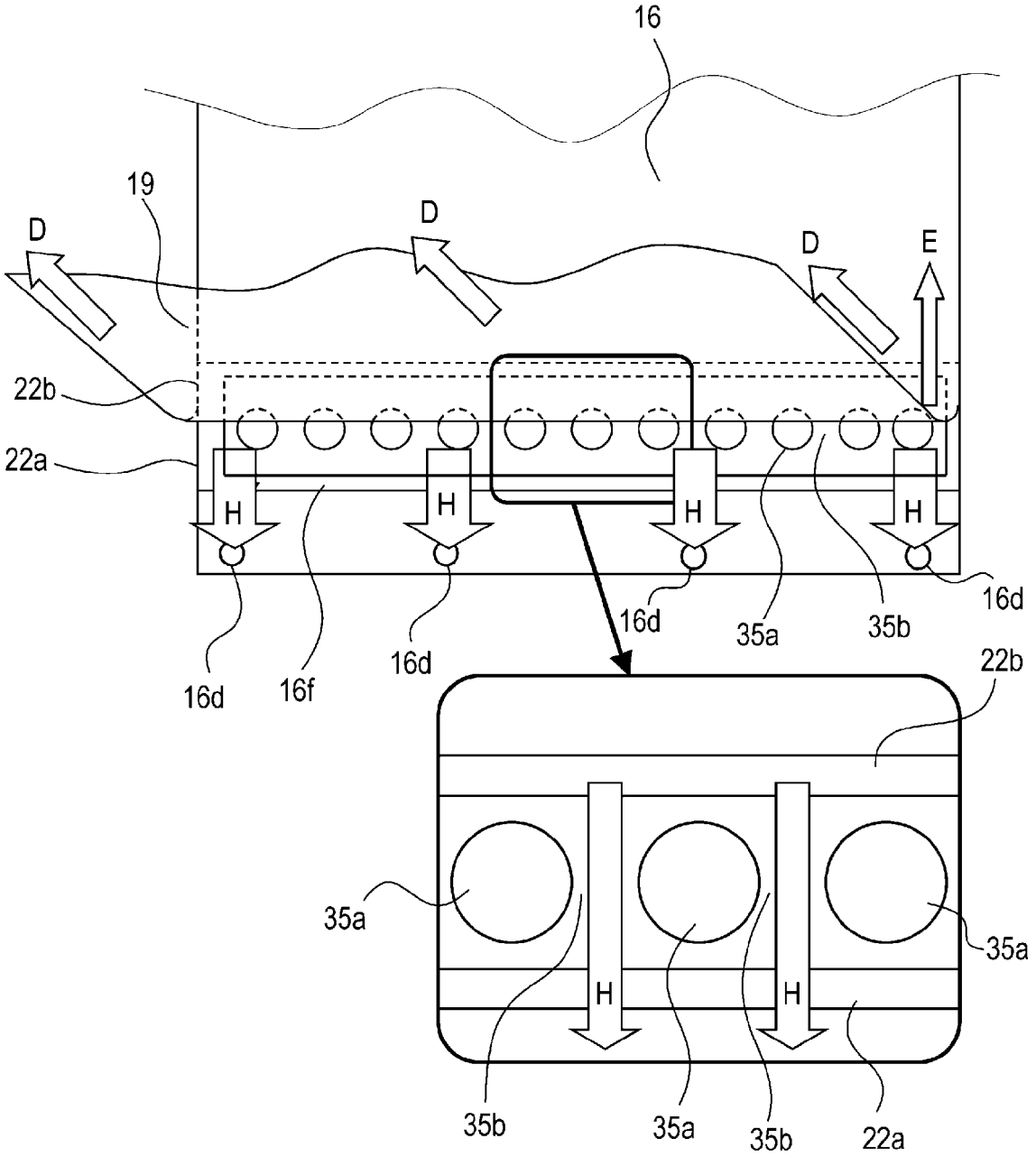

FIG. 11 is an enlarged plan view showing the structure of the discharging portion.

Figure 12:
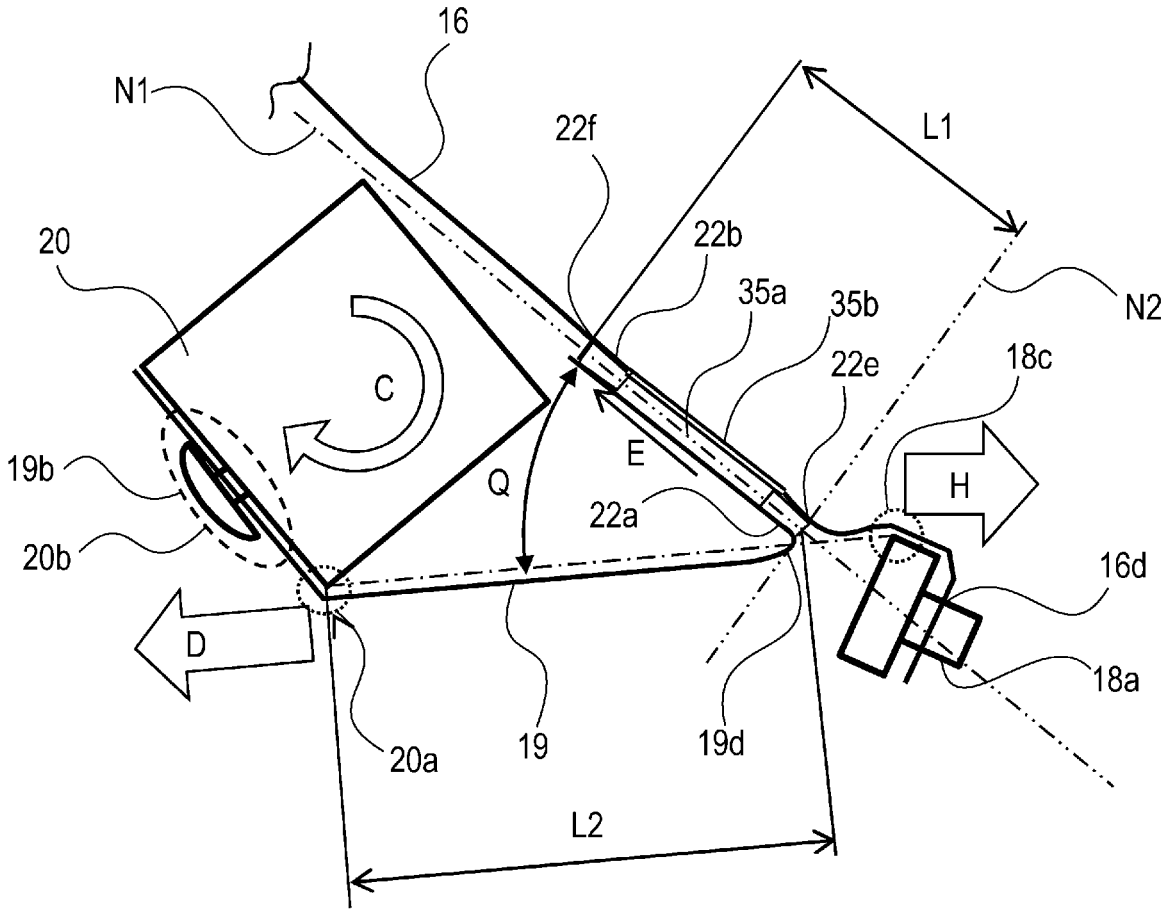

FIG. 12 is a sectional view for illustrating a dimensional relationship of the sealing member.

Figure 13:
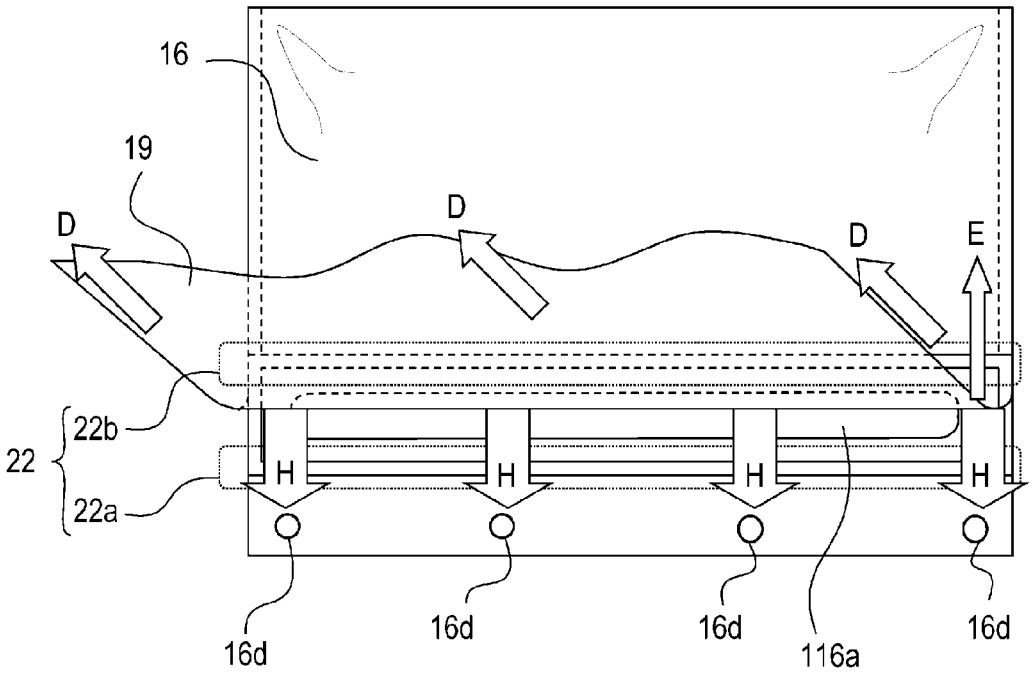
Figure 13:
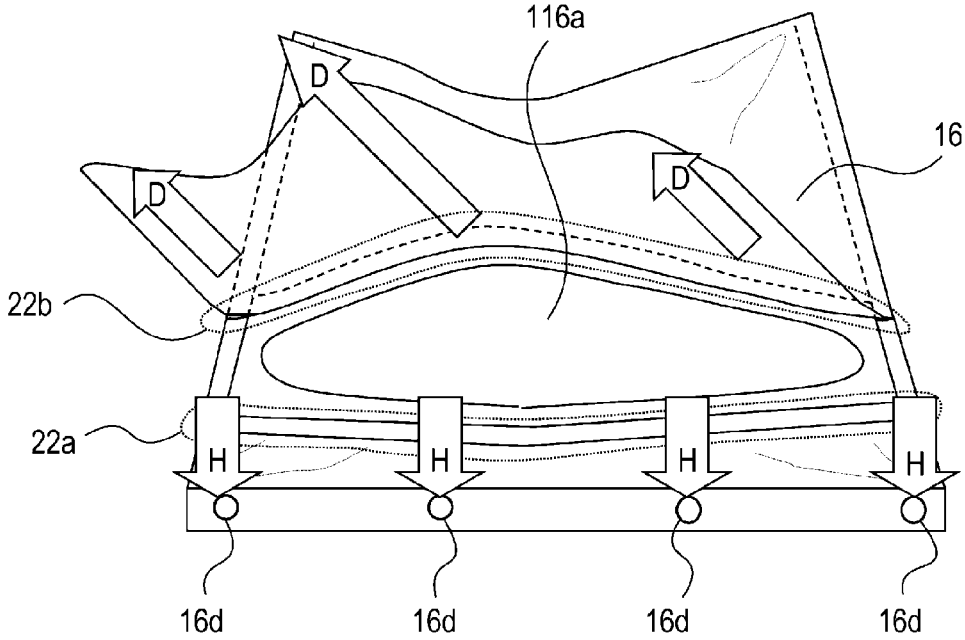

Parts (a) and (b) of FIG. 13 are schematic views showing a structure of the flexible container.

Figure 14:
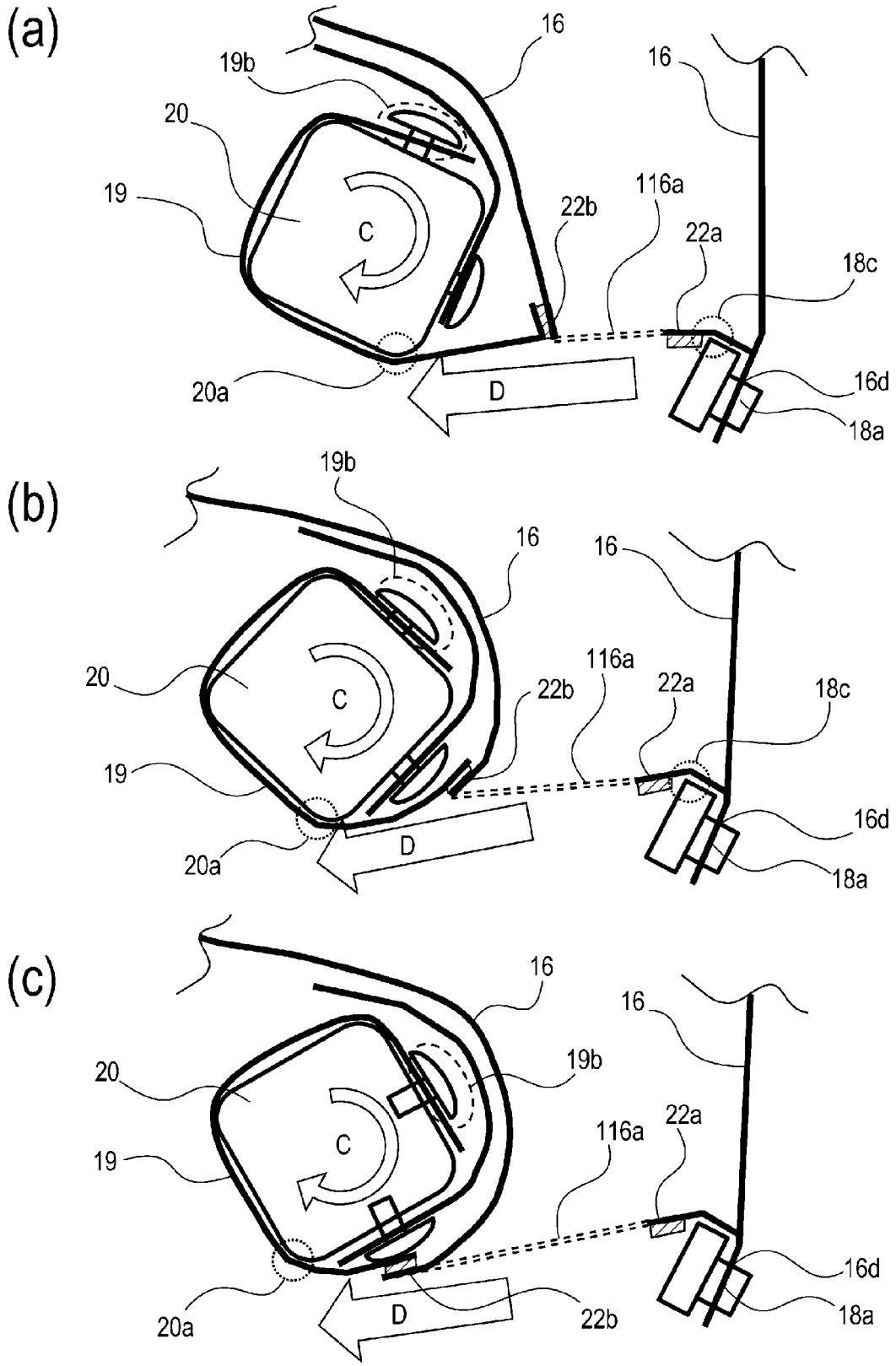

Parts (a) to (c) of FIG. 14 are sectional views for illustrating an operation of the sealing member.

Figure 15:
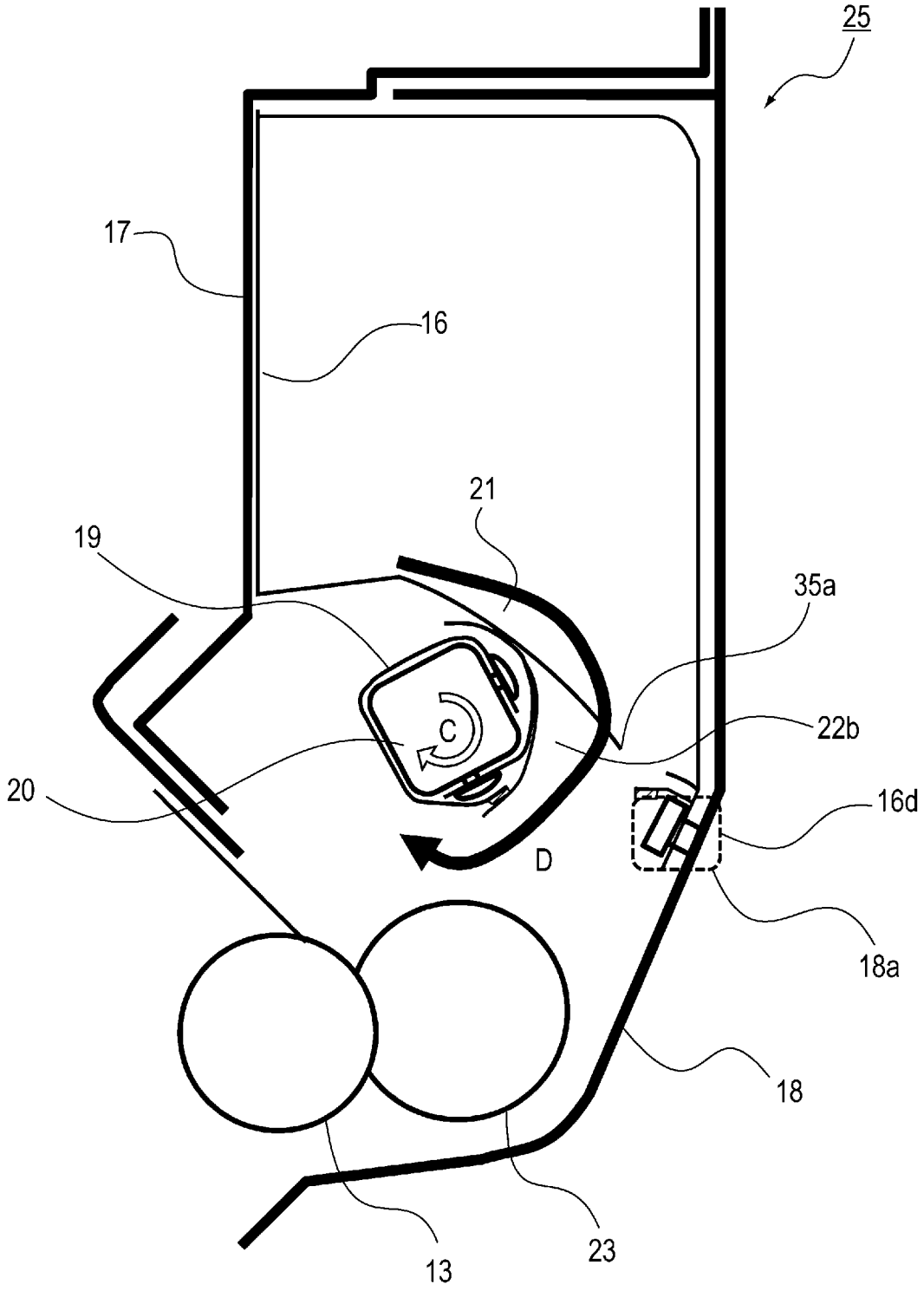
Figure 16:
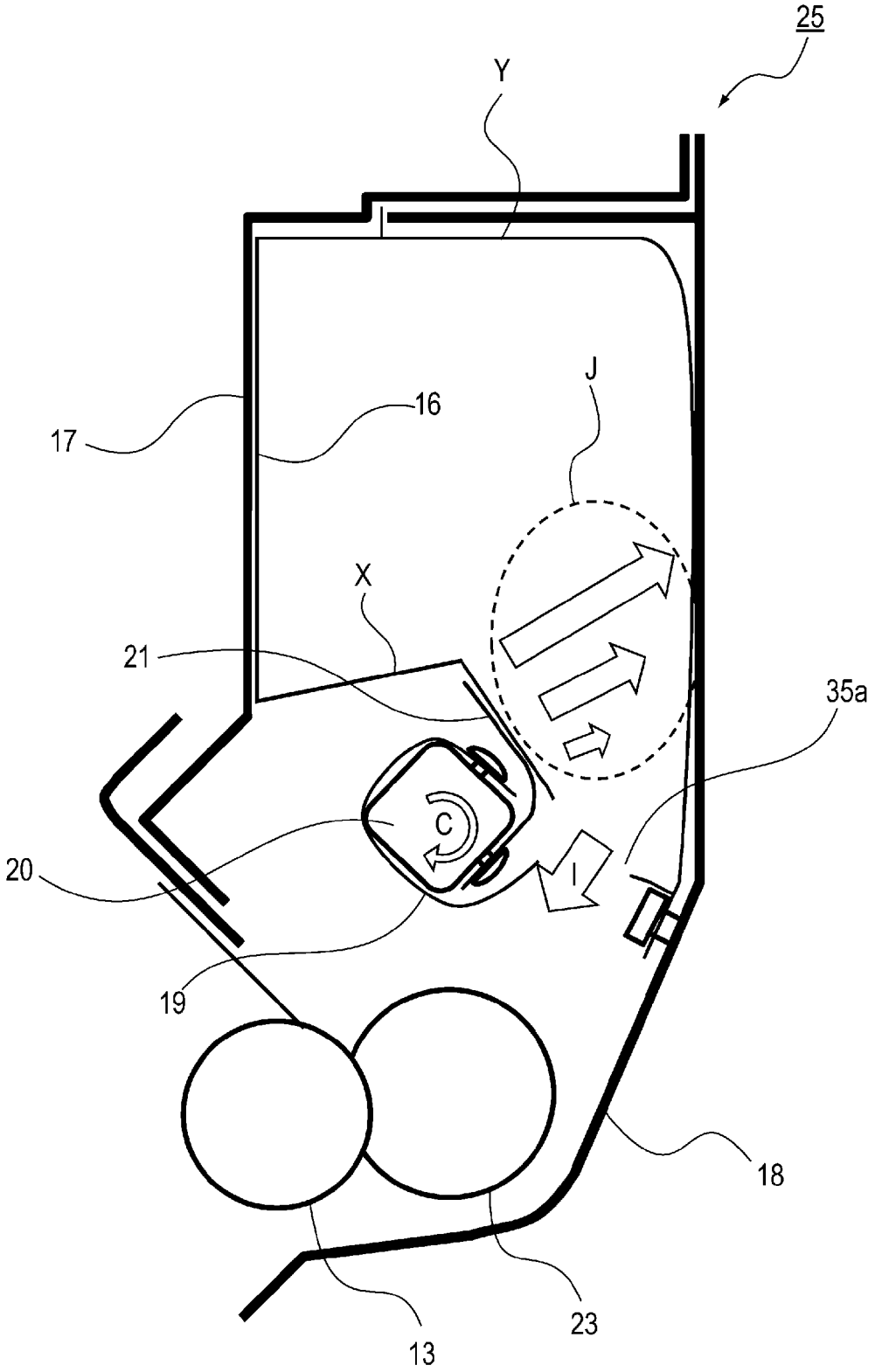
Figure 17:
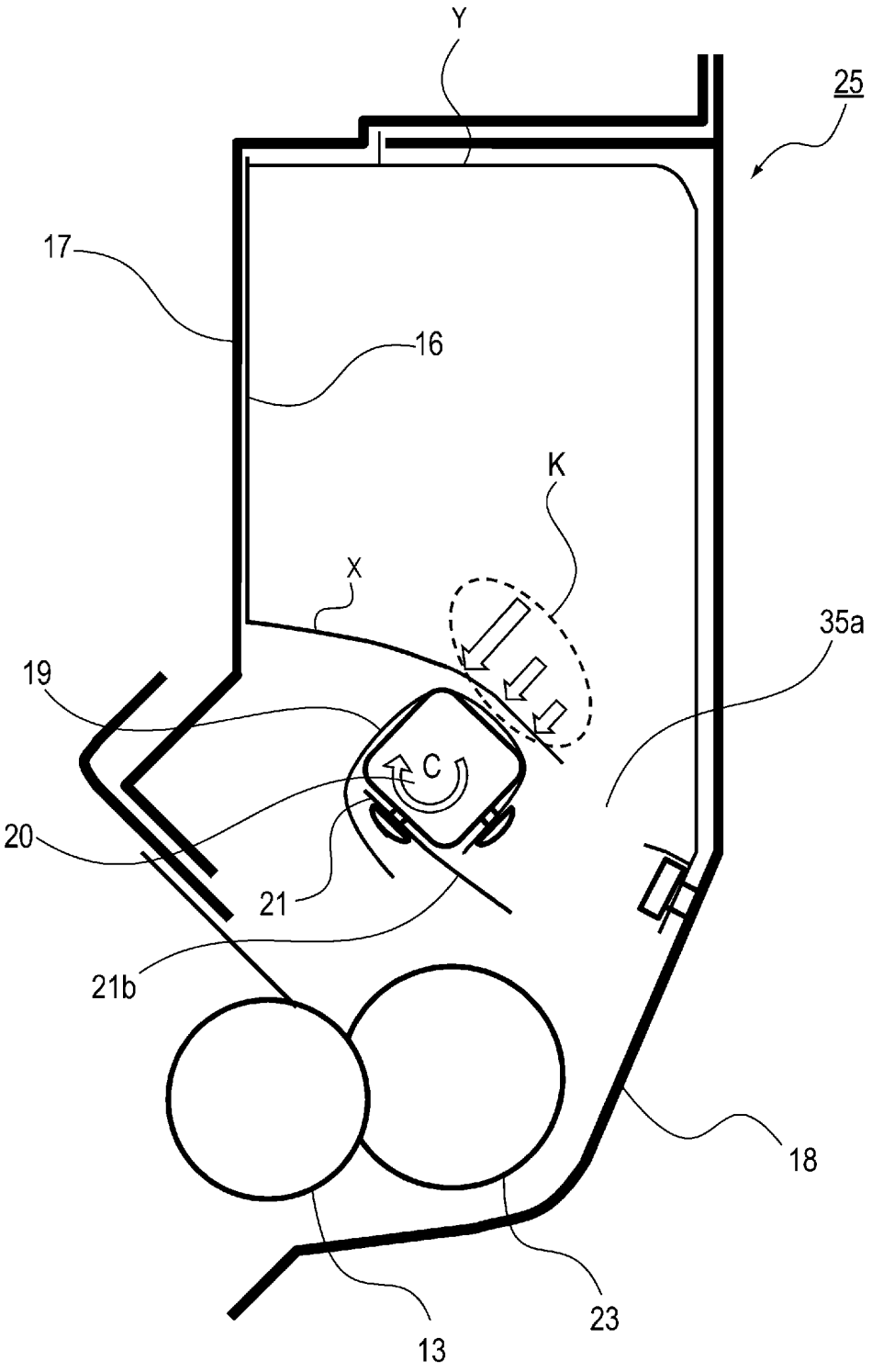

FIGS. 15 to 17 are sectional views for illustrating an operation of the flexible container inside the frame.

Figure 18:
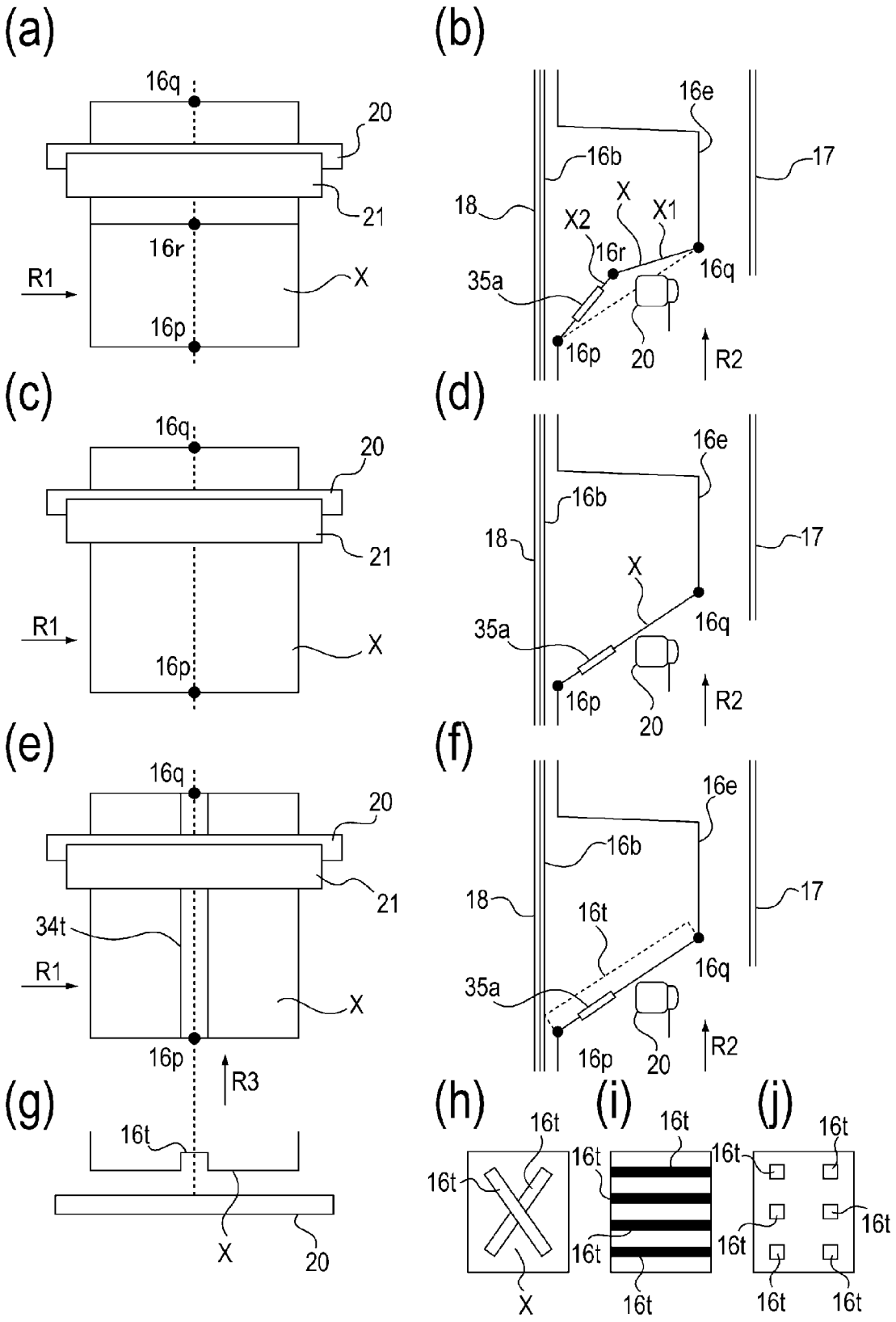

Parts (a) to (j) of FIG. 18 are schematic views for illustrating a structure of the developer accommodating unit.

Figure 19:
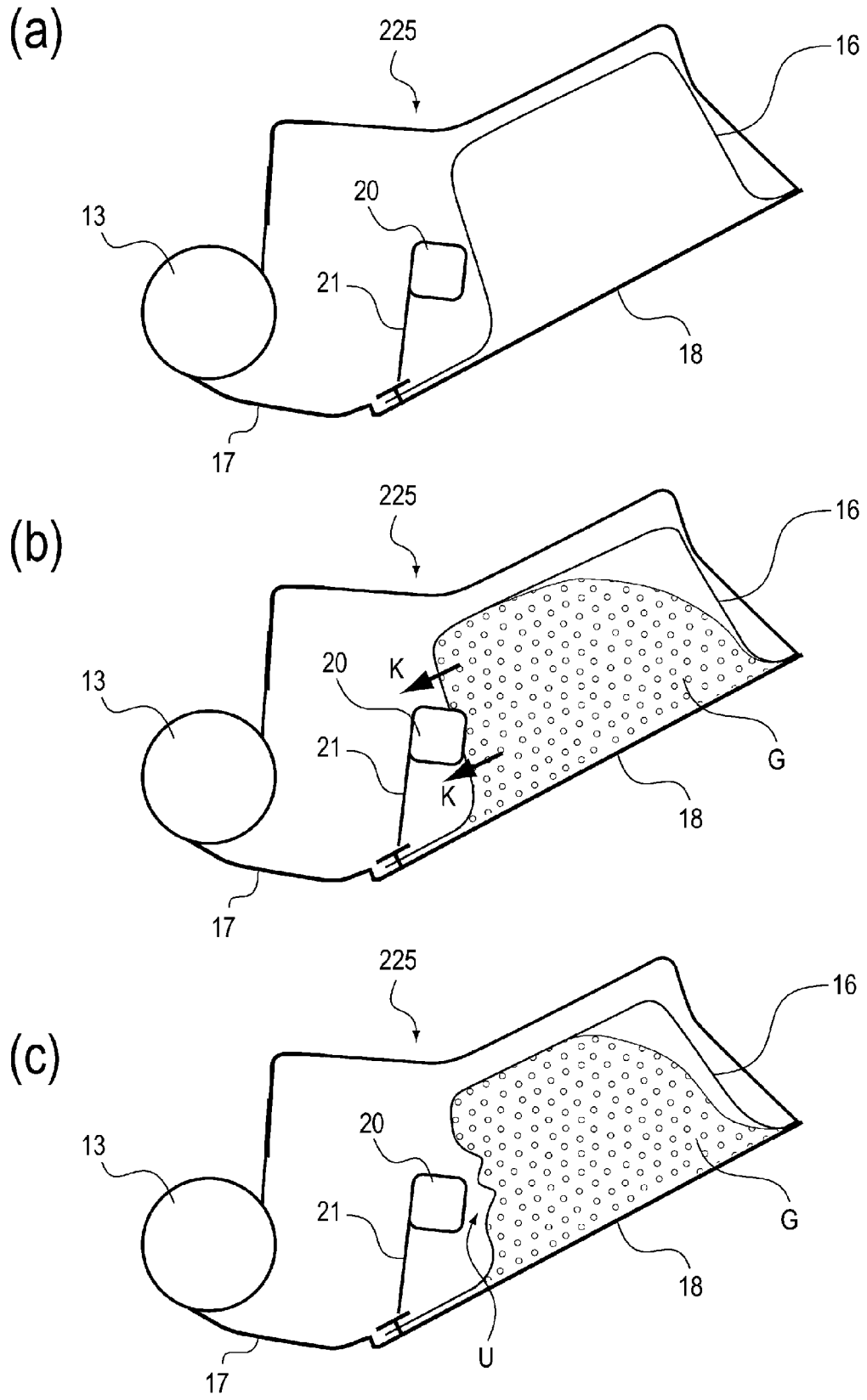

Parts (a) to (c) of FIG. 19 are a sectional view showing a structure of a developer accommodating unit in Embodiment 2.

Figure 20:
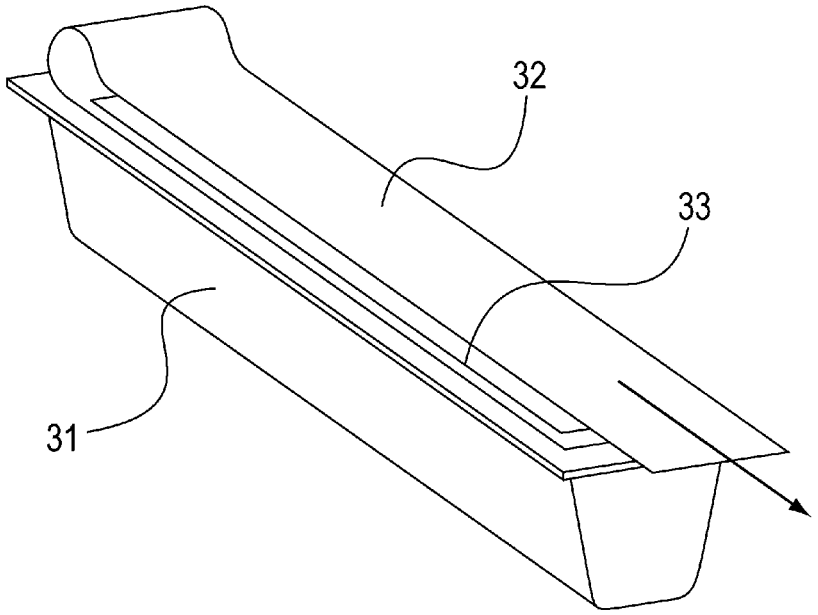

FIG. 20 is a perspective view showing a structure of a developer accommodating frame in a conventional example.

Figure 21:
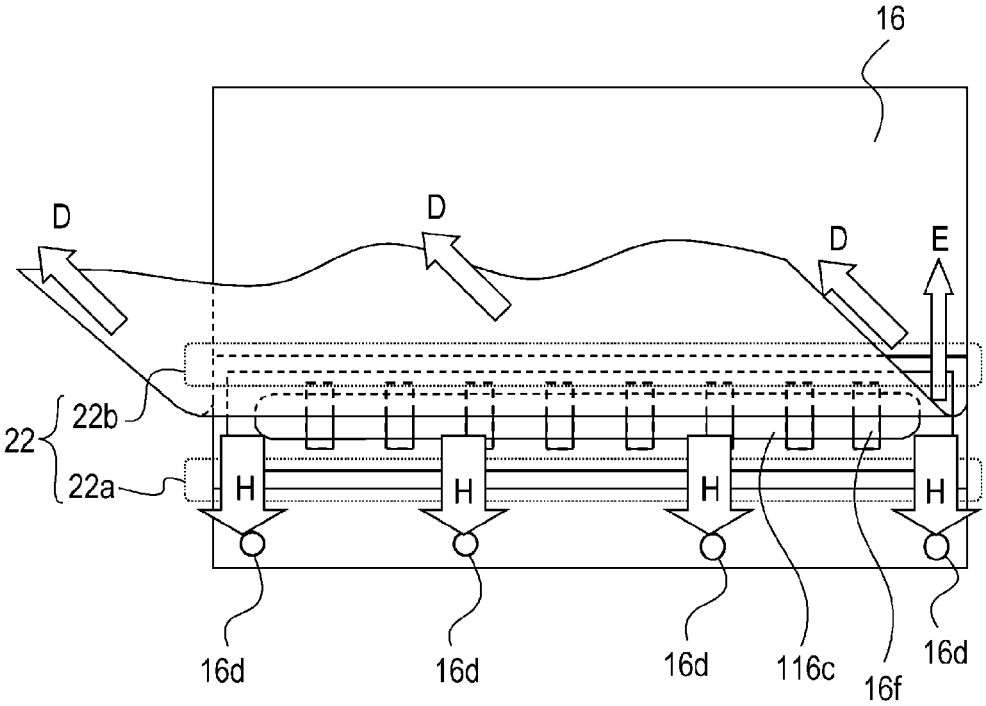
Figure 21:
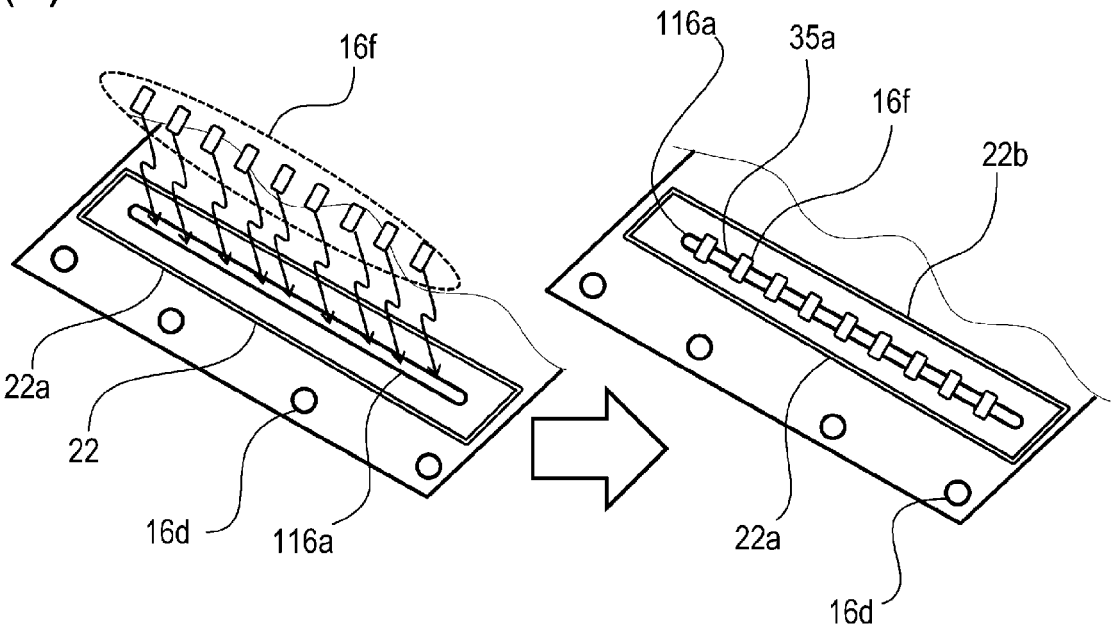

Parts (a) and (b) of FIG. 21 are schematic views for illustrating a structure of the discharging portion.

Figure 22:
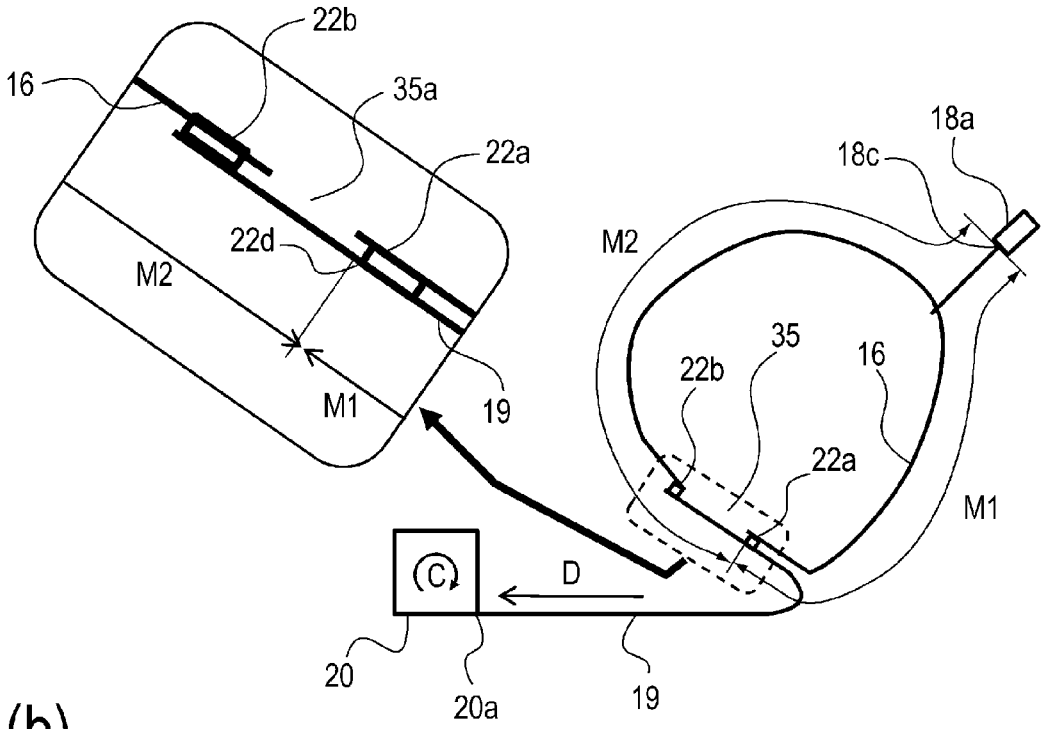
Figure 22:
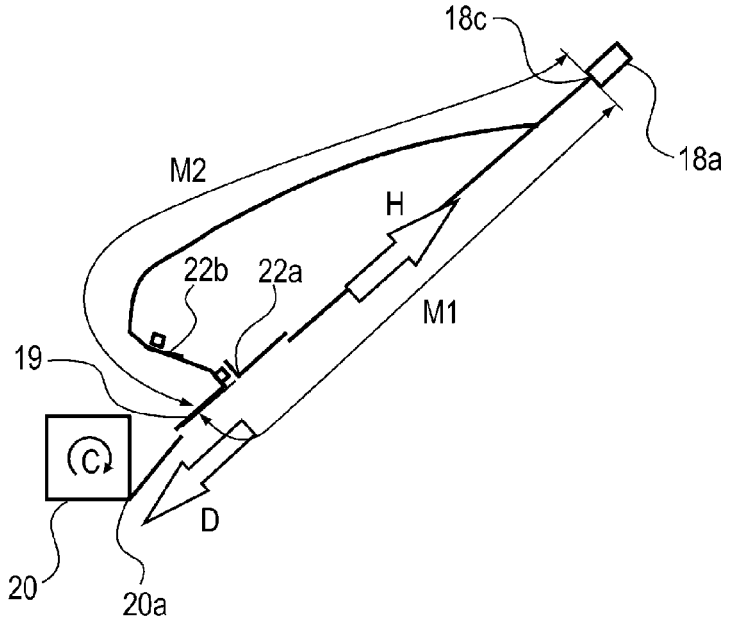
Figure 23:
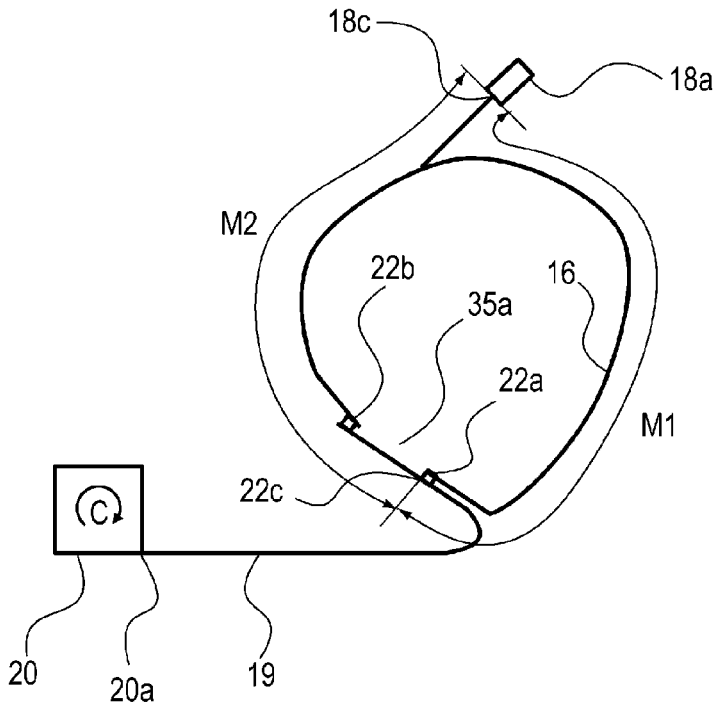
Figure 23:
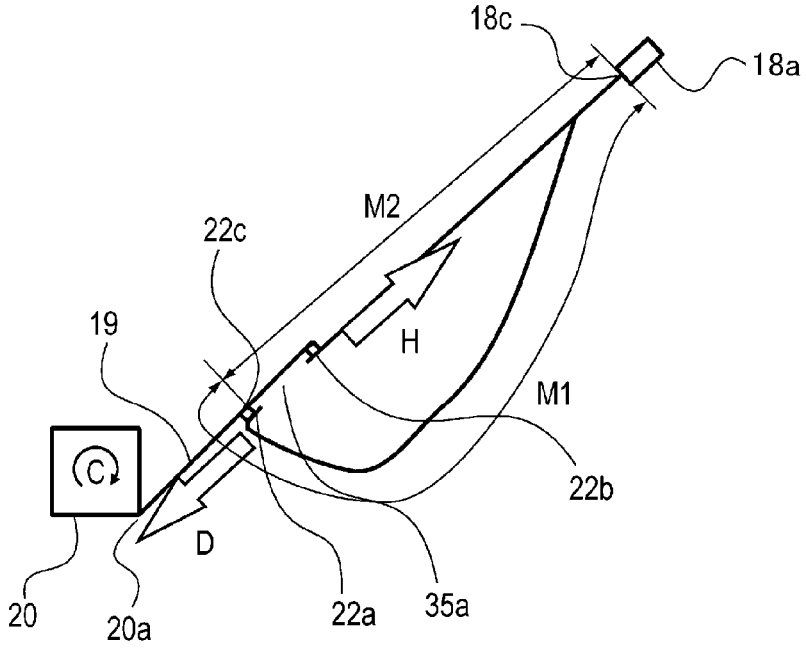
Figure 24:
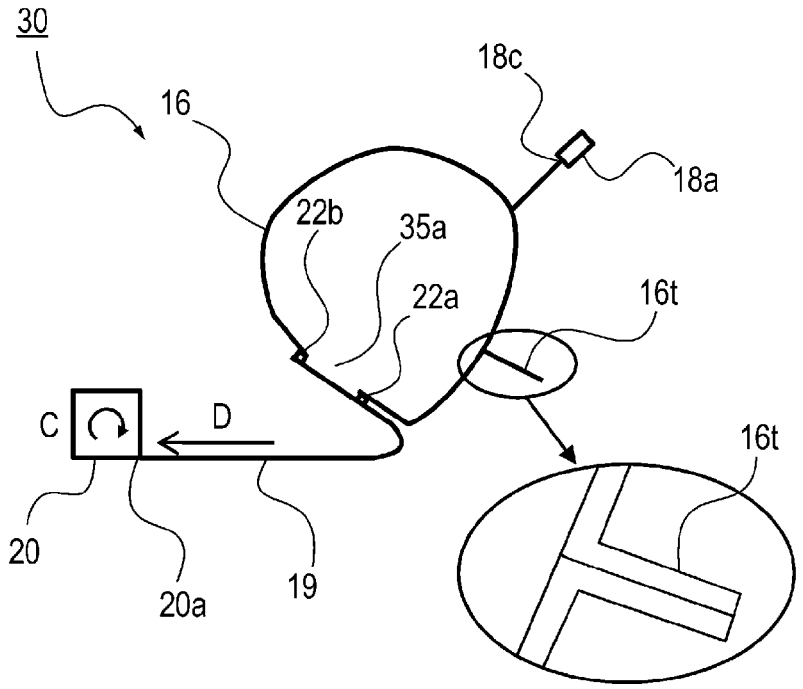
Figure 24:
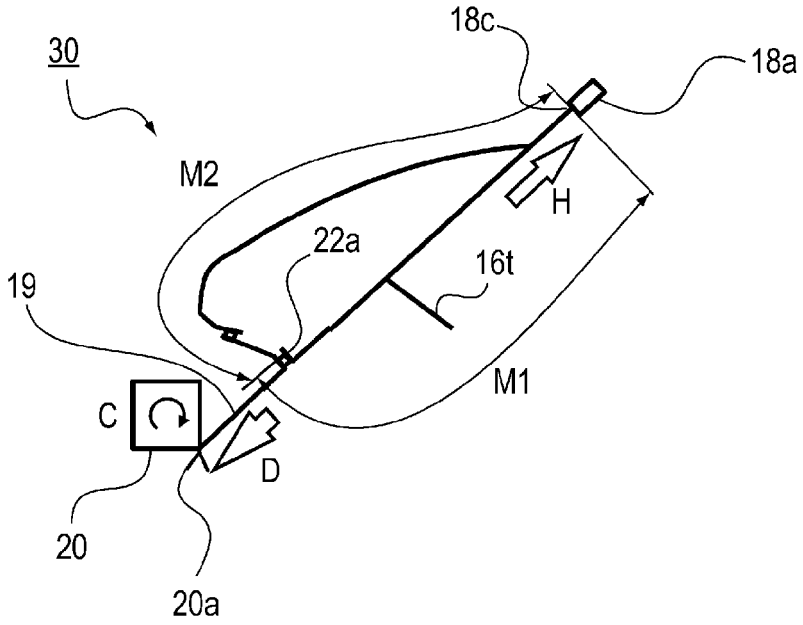

Parts (a) and (b) of FIG. 22, (a) and (b) of FIG. 23, and (a) and (b) of FIG. 24 are sectional views for illustrating a bonding portion.

Figure 25:
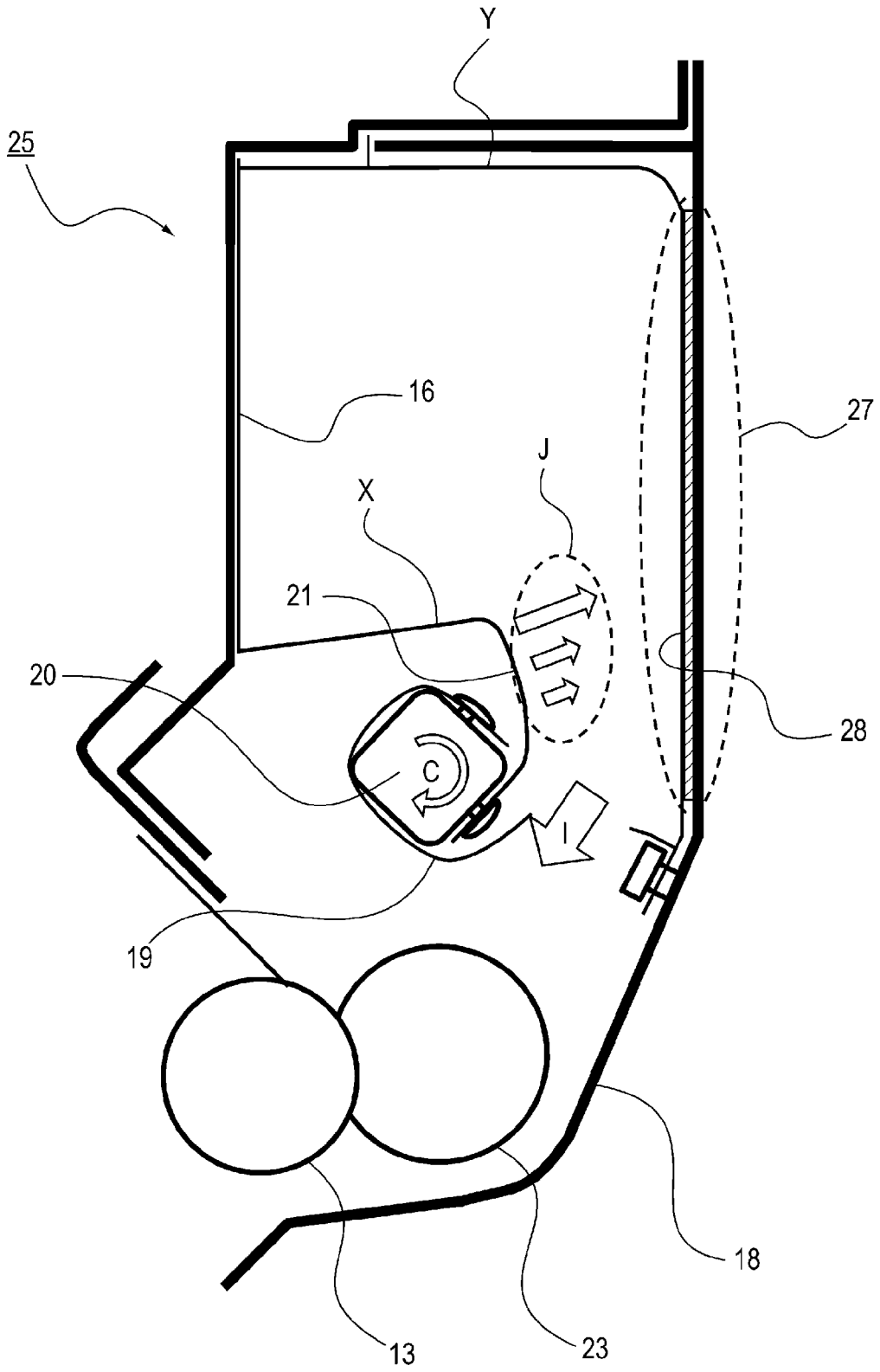

FIG. 25 is a sectional view for illustrating an operation of the sealing member.

Figure 26:
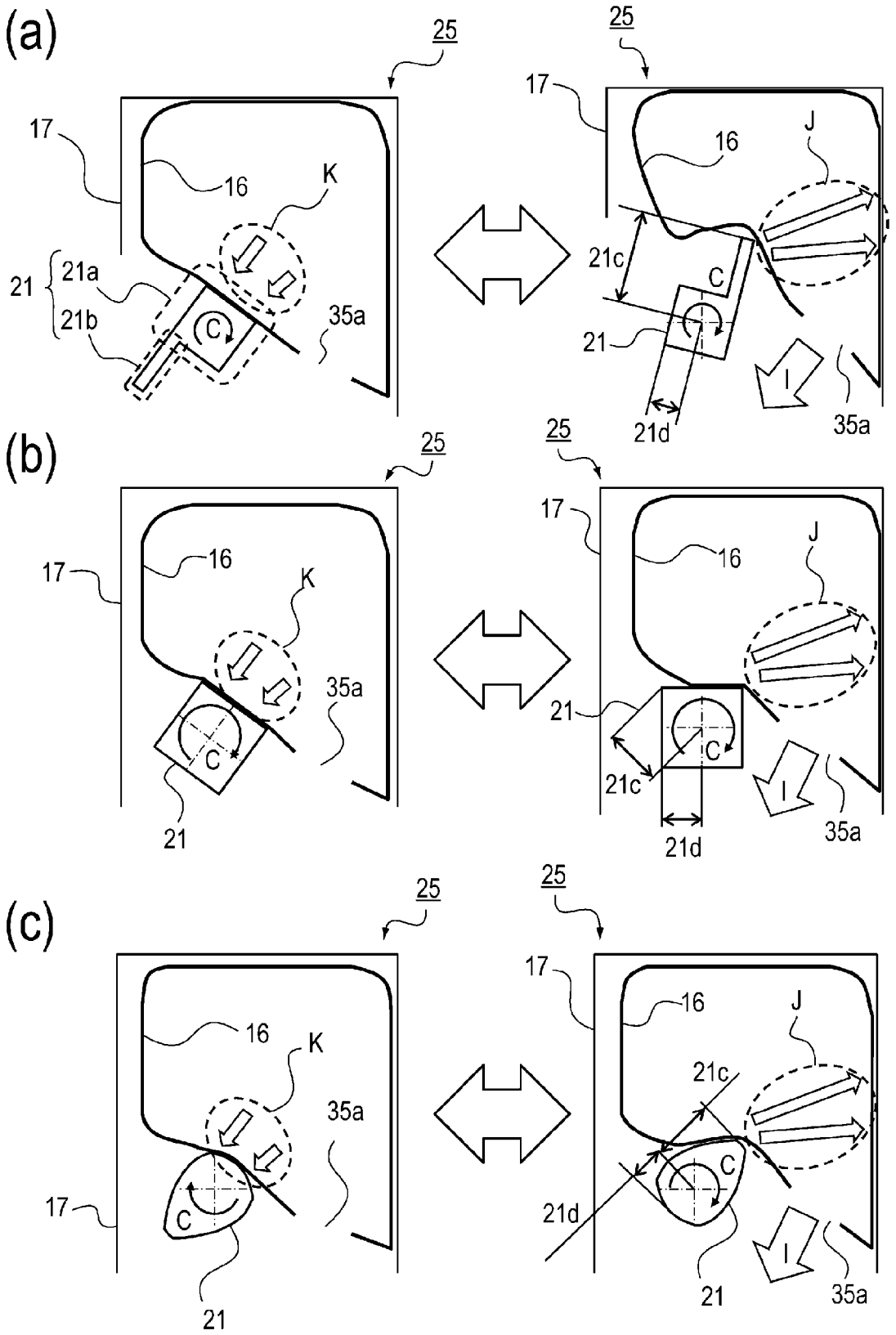

Parts (a) to (c) of FIG. 26 are sectional views each showing another structure of the urging member.

Figure 27:
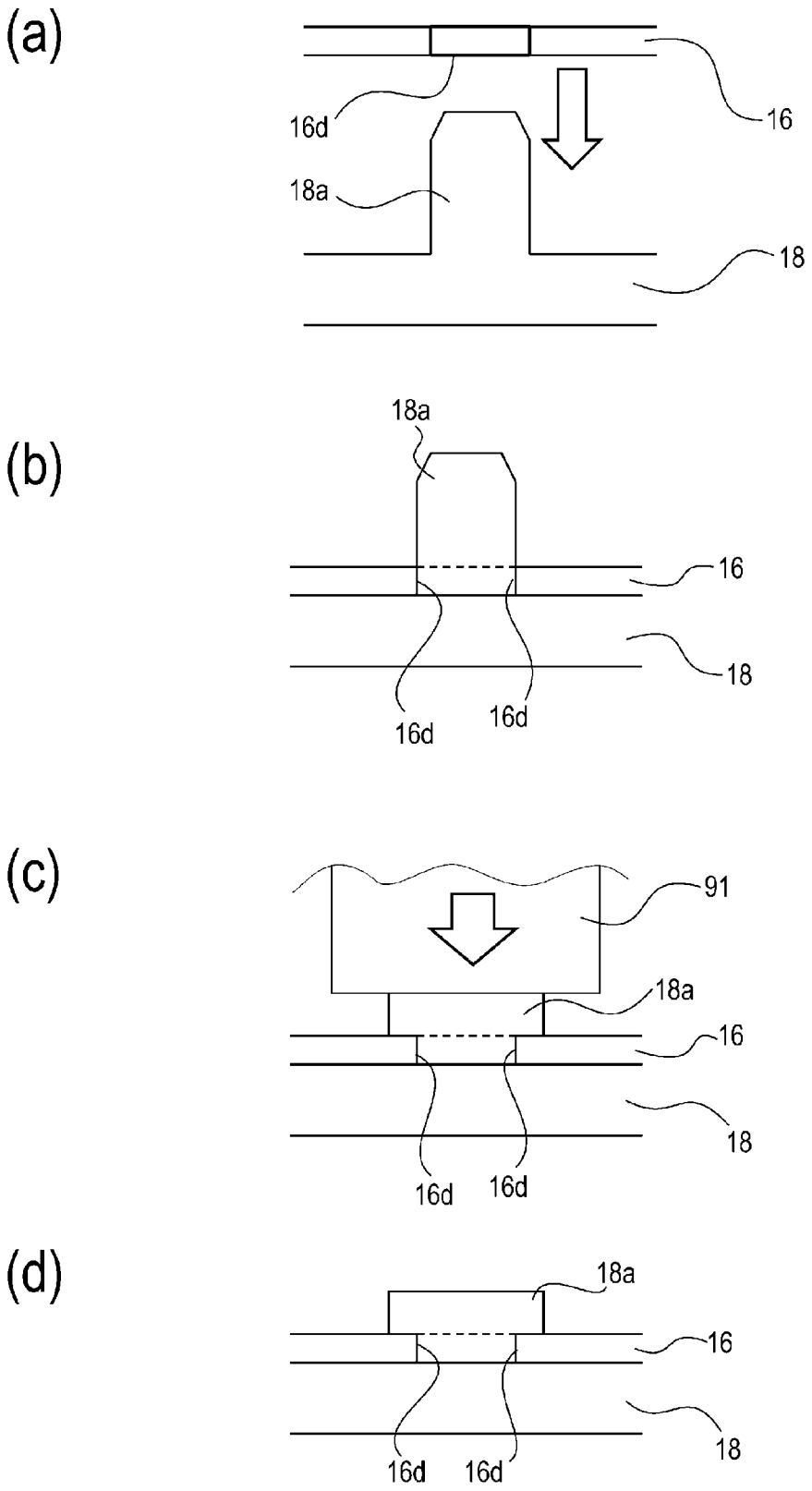

Parts (a) to (d) of FIG. 27 are sectional views for illustrating steps for fixing the flexible container to the frame.

Figure 28:
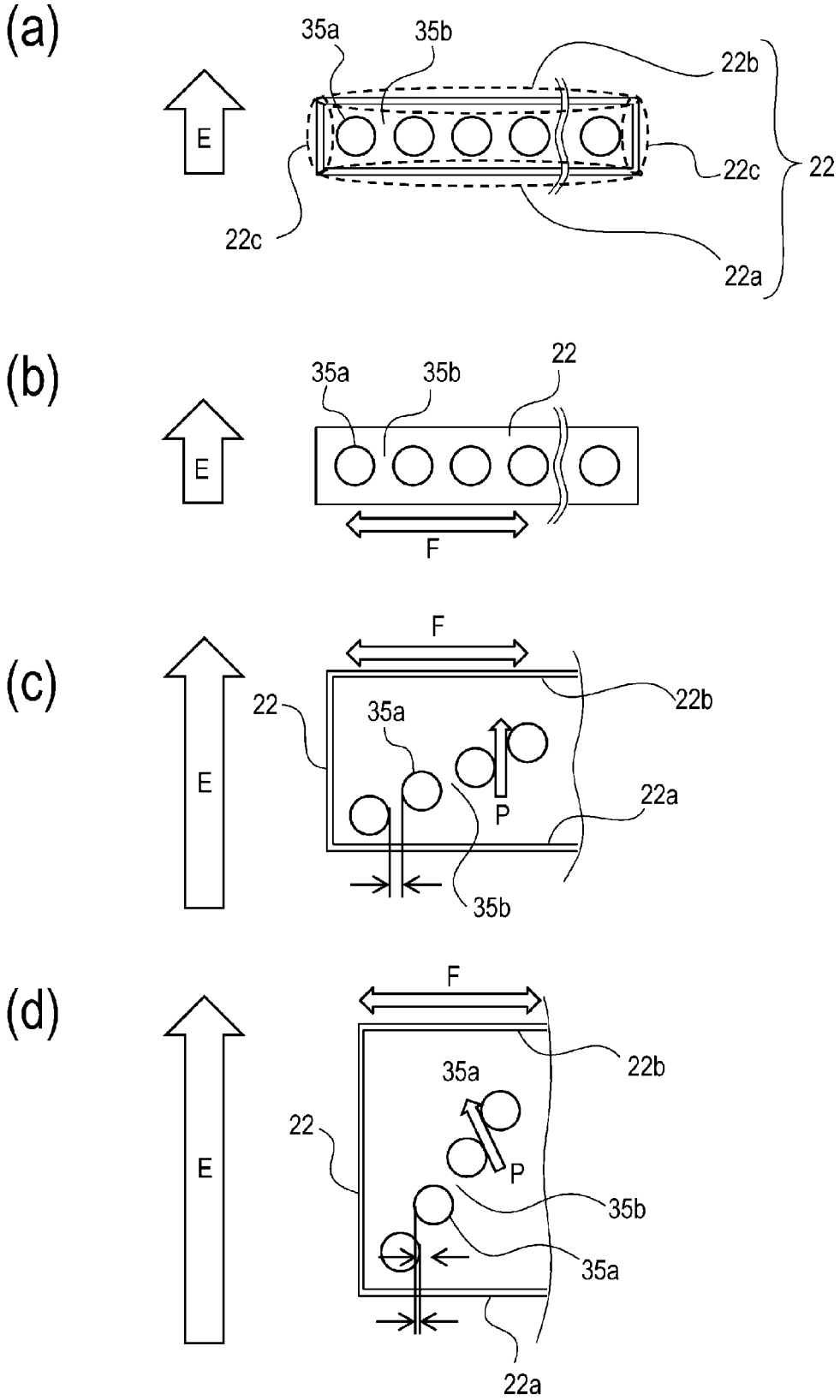

Parts (a) to (d) of FIG. 28 are plan views each showing a structure of the discharging portion.

Figure 29:
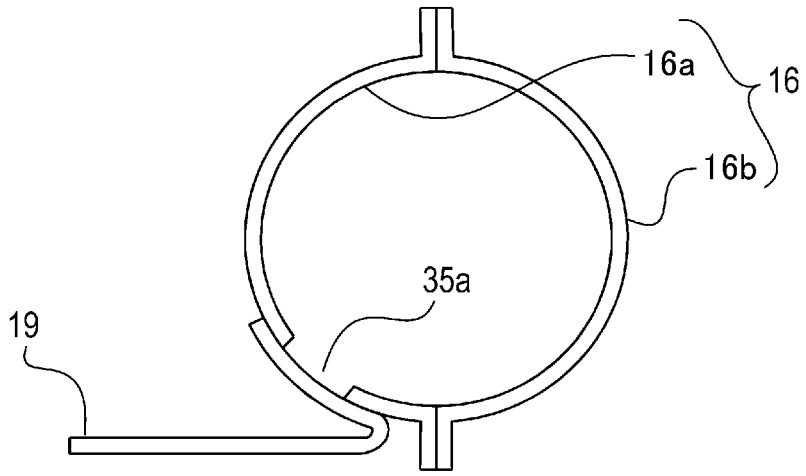
Figure 29:
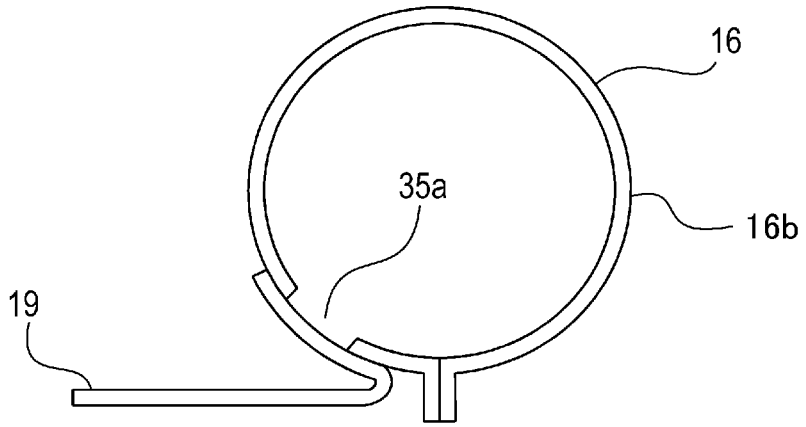

Parts (a) and (b) of FIG. 29 are sectional views each showing a structure of the flexible container.

Figure 30:
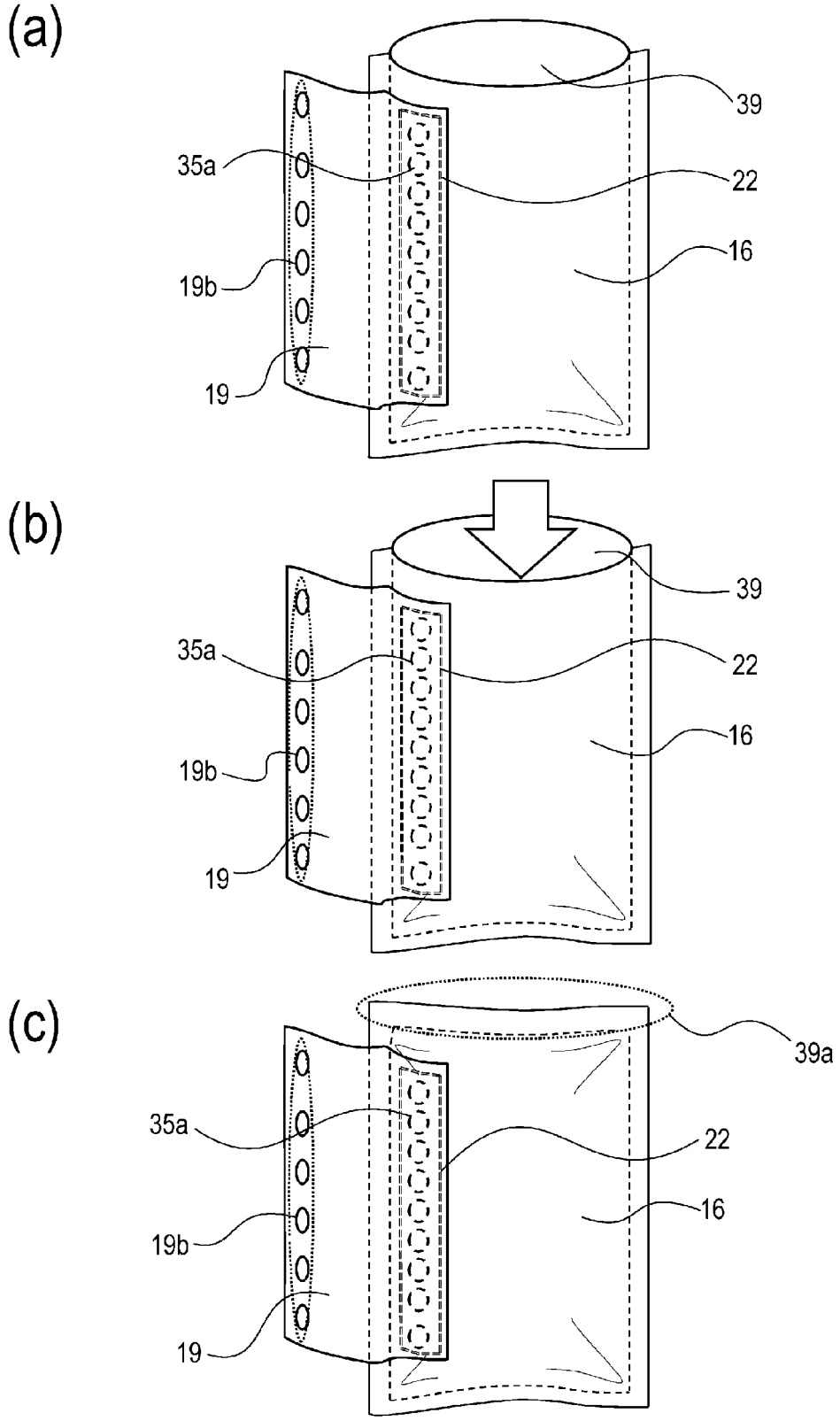

Parts (a) to (c) of FIG. 30 are side (perspective) views for illustrating the structure of the flexible container.

Figure 31:
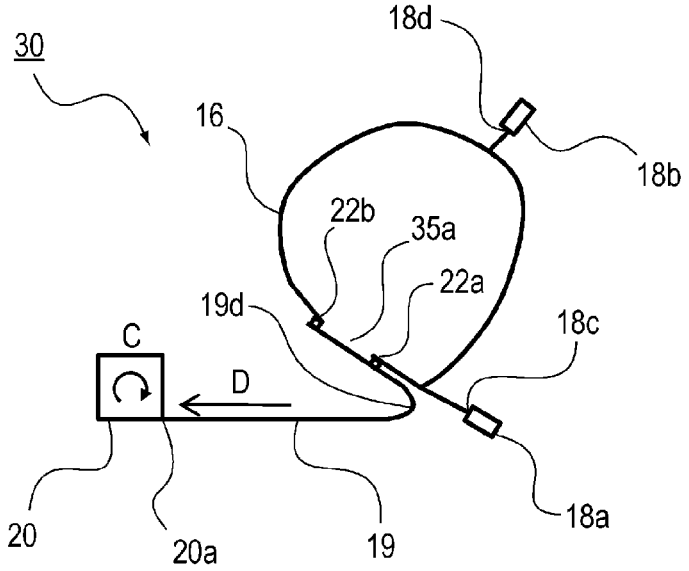
Figure 31:
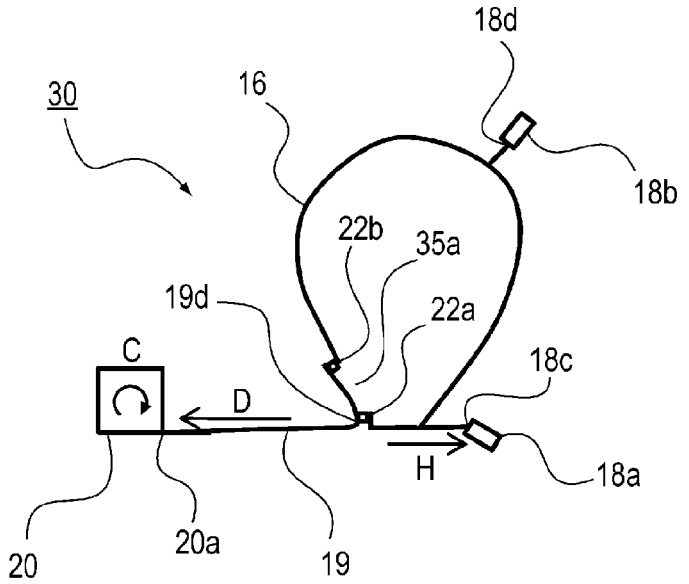

Parts (a) and (b) of FIG. 31 are sectional views for illustrating a state of the bonding portion.

Figure 32:
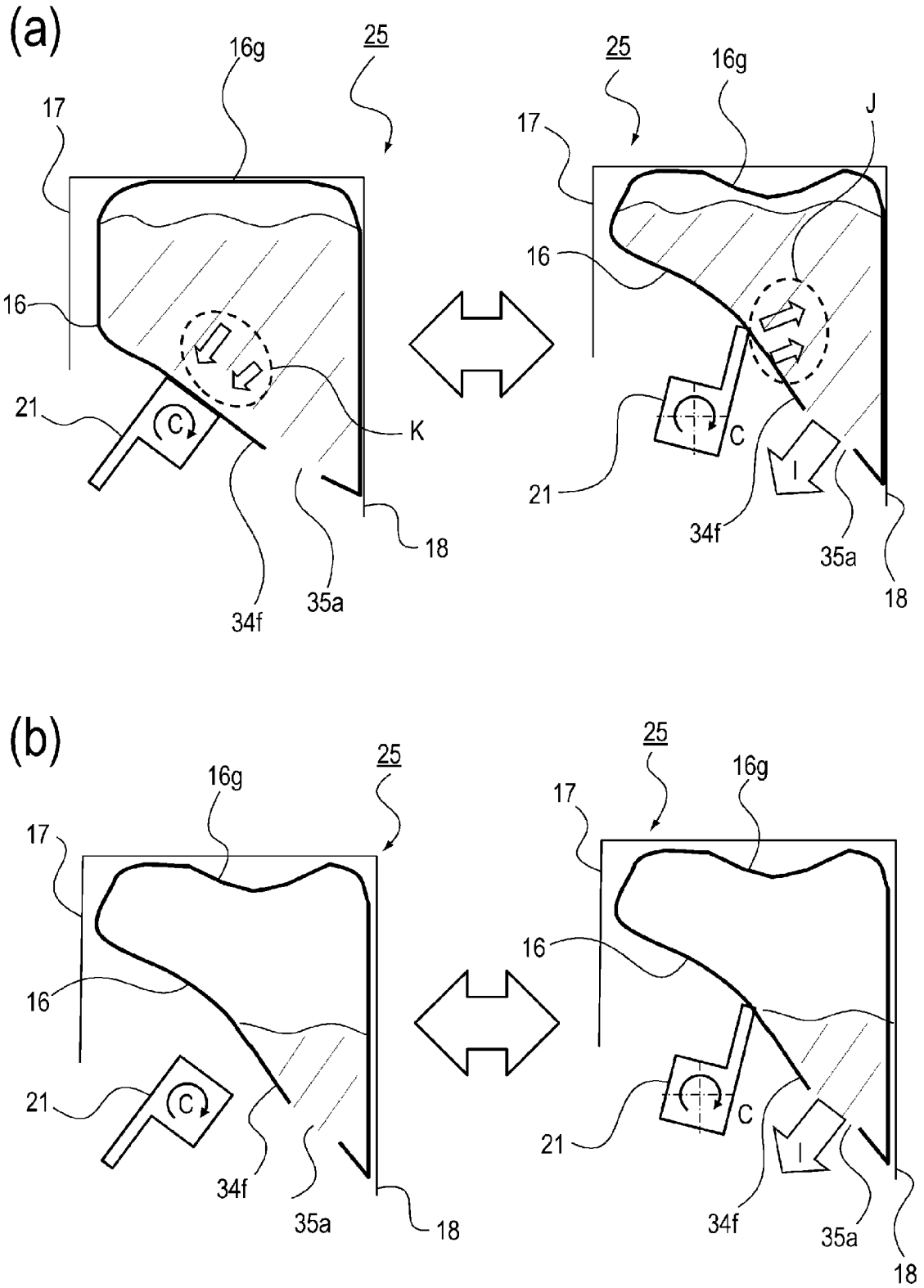

Parts (a) and (b) of FIG. 32 are sectional views for illustrating an operation of the flexible container.

DESCRIPTION OF THE PREFERRED EMBODIMENTS

Embodiment 1

Figure 2:
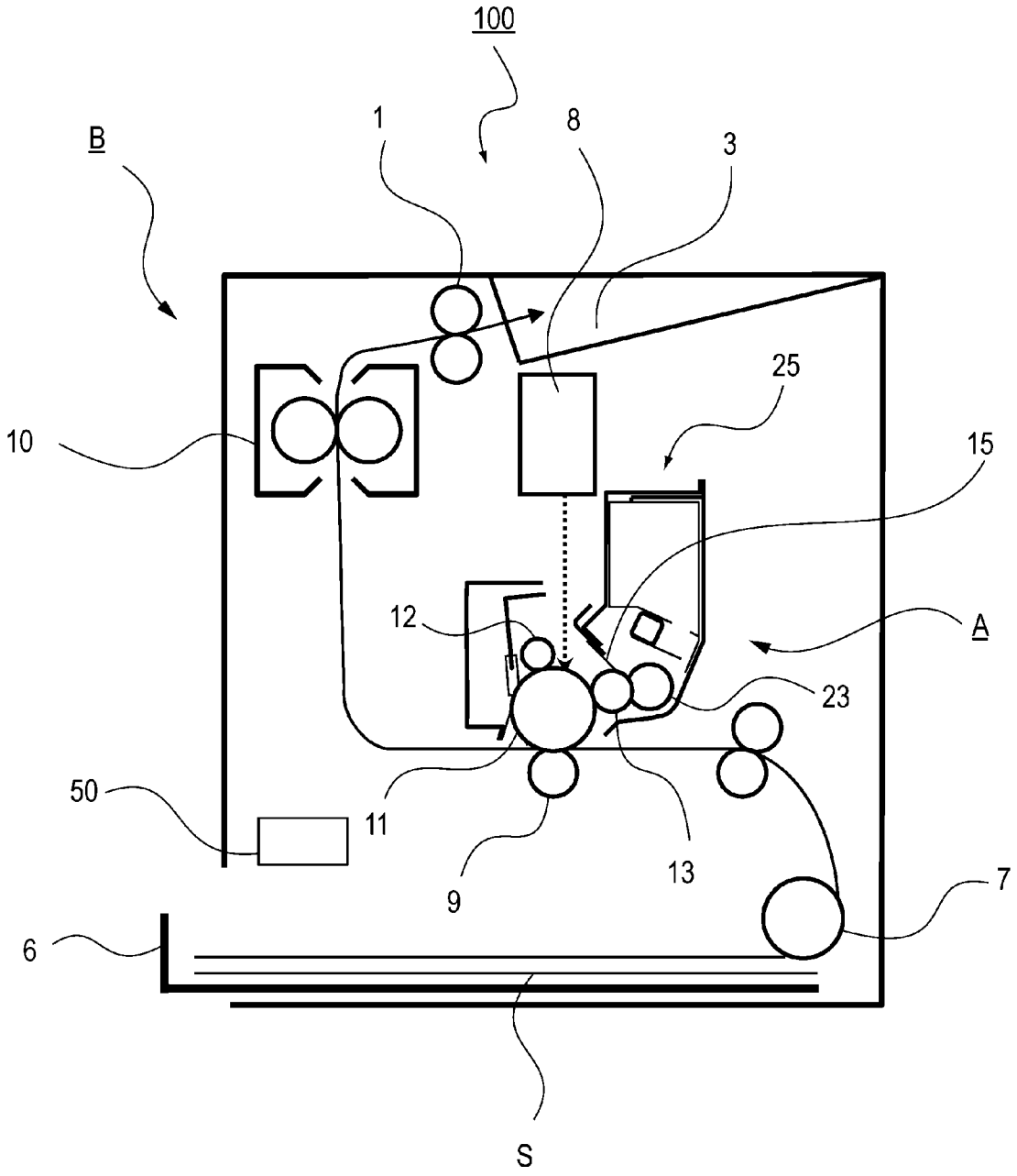
FIG. 2 is a sectional view showing a structure of an image forming apparatus.

FIG. 2 is a sectional view showing a structure of an image forming apparatus 100. As shown in FIG. 2, the image forming apparatus 100 as an electrophotographic image forming apparatus includes an apparatus main assembly B as an image forming apparatus main assembly and is constituted so that a cartridge A as a process cartridge is detachably mountable to the apparatus main assembly B. The cartridge A is prepared by integrally assembling a photosensitive drum 1 and a developer accommodating unit 25. In a sheet cassette 6 mounted to a lower portion of the apparatus main assembly B, sheets S are accommodated. During image formation, the sheet S is fed toward the photosensitive drum 11, as an electrophotographic photosensitive drum which is an image bearing member, by a feeding roller 7.

In synchronism with this operation, the surface of the photosensitive drum 11 is electrically charged uniformly by a charging roller 12 and exposed to light by an exposure device 8, so that an electrostatic latent image is formed on the surface of the photosensitive drum 11. In the cartridge A, a developer is accommodated and a developing roller 13 as a developer carrying member is provided. The developer is fed to the developing roller 13 by a supplying roller 23 to be carried in a thin layer on the surface of the developing roller 13 by a developing blade 15. Then, a developing bias is applied to the developing roller 13, so that the above-described electrostatic latent image is developed with the developer and thus a developer image is formed on the surface of the photosensitive drum 11.

The developer image is transferred onto the conveyed sheet S by a transfer roller 9 supplied with a bias voltage. Then, the sheet S is conveyed to a fixing device 10 to fix the developer image thereon, and then is discharged onto a discharge portion 3 by a discharging roller pair 1. Incidentally, the apparatus main assembly B includes a controller 50, and the controller 50 controls drive of inside devices of the apparatus main assembly B. Further, although described later, the controller 50 controls drive of an urging sheet 21 (FIG. 1) so that the urging sheet 21 can repetitively urge a developer accommodating member 16 (FIG. 1) which is a flexible container by rotating the urging sheet 21.

<Summary of Structure of Process Cartridge>

Figure 1:
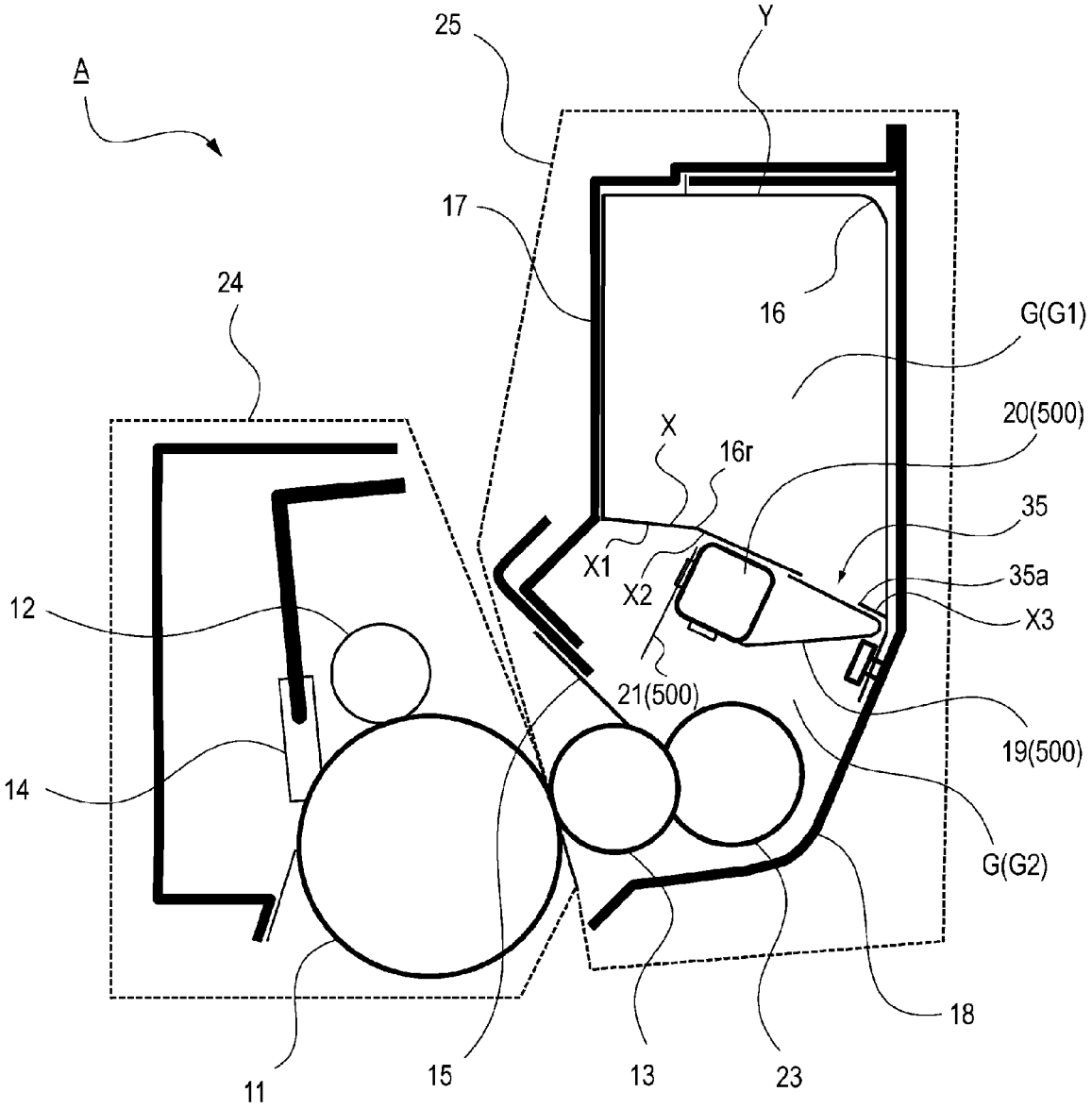
FIG. 1 is a sectional view showing a structure of a developer accommodating unit.

FIG. 1 is a sectional view showing a structure of the cartridge A. As shown in FIG. 1, the cartridge A includes a cleaner unit 24 and the developer accommodating unit 25. The cleaner unit 24 includes the photosensitive drum 11, a cleaning blade 14 for cleaning the surface of the photosensitive drum 11, and the charging roller 12 for electrically charging the surface of the photosensitive drum 11. The developer accommodating unit 25 includes the developing roller 13, the supplying roller 23 for supplying the developer to the developing roller 13, and the developer accommodating member 16 for accommodating the developer. The developer accommodating unit 25 will be described specifically below.

The developer accommodating unit 25 includes a frame 17 as a first frame and a frame 18 as a second frame. In an upper region of the frames 17 and 18, the developer accommodating member 16 and an urging member 500 (urging body or urging means) are disposed. The urging member 500 includes, although described later, the urging sheet 21, a sealing member 19 and a rotatable member 20. The present invention is characterized by the developer accommodating member 16 which is the flexible container. The developer accommodating member 16 is provided with openings 35*a* for permitting discharge of a developer G (G1), and is a container for accommodating the developer G (G1). In a lower region of the frames 17 and 18, the developing roller 13 and the supplying roller 23 are disposed. By employing such a constitution, the developer accommodating unit 25 is configured to accommodate the developer accommodating member 16 containing the developer in the upper region of the frames 17 and 18 and to accommodate the developer G (G2) after being discharged from the developer accommodating member 16 in the lower region of the frames 17 and 18.

The urging member 500 is disposed below, with respect to a vertical direction, an opening-containing side X of the developer accommodating member 15. The urging member includes the rotatable member 20, the sealing member 19 and the urging sheet 21. Further, at a surface of the rotatable member 20, the sealing member 19 and the urging sheet 21 are fixed. The sealing member 19 is a member for urging the developer accommodating member 16 after the sealing member 19 seals the openings 35*a* and then unseals the openings 35*a* by rotation of the rotatable member 20. Further, the urging sheet 21 urges, during or after an operation in which the sealing member 19 unseals the openings 35*a*, the opening-containing side X of the developer accommodating member 16 to deform the developer accommodating member 16.

The developer accommodating member 16 includes the opening-containing side X. The opening-containing side X includes a first sides X1 and a second side X2 which are side where the developer G accommodated in the developer accommodating member 16 receives gravitation and which are a plurality of sides defined by a bent portion 16*r* for bending the sides, and the first side X1 and the second side X2 receive an urging force of the urging member 500. The first side X1 and the second side X2 are partitioned by the bent portion 16*r*, as a boundary, for bending the opening-containing side X, and the first side X1 is disposed at an upper position than the second side X2 with respect to the vertical direction. The opening-containing side X further includes a third side X3, and between the second side X2 and the third side X2, the openings 35*a* are formed. The second side X2 is disposed at an upper position than the third side X2 with respect to the vertical direction.

Thus, the opening-containing side X has the constitution including the bent portion 16*r*, and therefore compared with a constitution in which the opening-containing side is formed as a flat side which does not include the bent portion 16*r*, the opening-containing side X is strong against flexure (bending) and thus is increased in strength. Therefore, even when the rotatable member 20 is disposed at an opposing position to the second side X2, the strength of the opening-containing side X is increased, and therefore the opening-containing side X is prevented from being flexed (bent) by the weight of the developer filled (accommodated) inside the developer accommodating member 16 and thus all the loads are not exerted on the rotatable member 20. As a result, the rotatable member 20 can be disposed at a position closer to the developer accommodating member 16, and therefore the developer accommodating unit 25 can be lowered in height with respect to the vertical direction, thus leading to downsizing of the cartridge A. Incidentally, the reason why the opening-containing side X is strong against the flexure by including the bent portion 16*r* will be explained in (Structure of developer accommodating member 16) described later.

<Summary of Structure of Developer Accommodating Unit>

Part (a) of FIG. 3 is a perspective view showing an inside mechanism of the frames 17 and 18 in cross section. FIG. 4 is a sectional view showing a structure of the developer accommodating unit 25 and shows a state in which a sealing portion 19*a* of the sealing member 19 closes (covers) the openings 35*a*. FIG. 6 is a sectional view showing a structure of the developer accommodating unit 25 and shows a state in which the sealing portion 19*a* of the sealing member 19 opens (unseals) the openings 35*a*.

As shown in FIG. 3, at an upper portion of the developer accommodating member 16, fixing portions 16*e* for fixing the developer accommodating member 16 to the frames 17 and 18 are formed, and at a lower portion of the developer accommodating member 16, fixing portions 16*d* for fixing the developer accommodating member 16 to the frame 17 are formed. The fixing portions 16*e* and 16*d* are holes. At a part of the surface of the developer accommodating member 16, a discharging portion 35 extending in a longitudinal direction of the flexible container 16 is formed. The discharging portion 35 includes the openings 35*a* for permitting the discharge of the developer and connecting portions 35*b* for connecting (defining) the openings 35*a*. Herein, a side including the discharging portion 35 is referred to as the opening-containing side X also from the viewpoint that the side contains the openings 35*a*.

At an opposing position to the opening-containing side X of the developer accommodating member 16, the rotatable member 20 is disposed. The rotatable member 20 is a member rotatable about its shaft (axis) as a rotation center. On the rotatable member 20, a base end portion of the sealing member 19 is fixed. Specifically, as shown in FIG. 4, the sealing member 19 includes an engaging portion 19*b*, a connecting portion 19*c* and the sealing portion 19*a*. The engaging portion 19*b* is fixed on the rotatable member 20, and the sealing portion 19*a* is fixed on the discharging portion 35. When the rotatable member 20 is rotated in an arrow C direction, the sealing portion 19*a* opens the openings 35*a*. The sealing member 19 is fixed on the rotatable member 20 at the engaging portion 19*b* by a retaining member (FIG. 4) and is fixed on the discharging portion 35 so as to block the openings 35*a* at the sealing portion 19*a*.

As shown in FIG. 4, on the rotatable member 20, the urging sheet 21 is fixed. When the rotatable member 20 is rotated, the urging sheet 21 urges and urge-releases the developer accommodating member 16 while being rotated. The urging sheet 21 is fixed on the rotatable member 20 at its base end portion by a retaining member. The fixing portions 16*e* of the developer accommodating member 16 are fixed to fixing portions 18*b* of the frame 18. The fixing portions 16*d* of the developer accommodating member 16 are fixed to fixing portions 18*c* of the frame 18. Thus, the developer accommodating member 16 is supported inside the frames 17 and 18.

As shown in FIG. 6, when the rotatable member 20 is rotated, the sealing portion 19*a* of the sealing member 19 is gradually separated (peeled) from the openings 35*a*. At the same time, the urging sheet 21 approaches the developer accommodating member 16 in order to urge the developer accommodating member 16.

(Developer Accommodating Member in which Developer is Accommodated)

Parts (a) to (c) of FIG. 30 are perspective views showing a structure of the developer accommodating member 16. As shown in (a) of FIG. 30, the developer accommodating member 16 is provided, at its one longitudinal end, with a filling opening 39 through which the developer is to be injected. Further, the developer accommodating member 16 is provided, at its side, with the plurality of openings 35*a* arranged in a line in the longitudinal direction (although the openings 35*a* may also be arranged in a plurality of lines). To the openings 35*a* of the developer accommodating member 16, the sealing member 19 is applied. Thus, an end portion of the sealing member 19 is applied onto the developer accommodating member 16 so as to seal the openings 35*a*, and at a base end portion of the sealing member 19, a hole as the engaging portion 19*b* to be engaged with the retaining member of the rotatable member 20 is formed. Incidentally, the developer is powder. Further, in a state shown in (a) of FIG. 30, the developer accommodating member 16 is not filled with the developer and the filling opening 39 for permitting the filling of the developer is open.

As shown in (b) of FIG. 30, the developer is injected (charged) into the developer accommodating member 16 from the filling opening 39 in an arrow direction, so that the inside of the developer accommodating member 16 is filled with the developer. By flexibility of the developer accommodating member 16, the filling opening 39 for permitting the filling of the developer is deformable correspondingly to a filling device and thus the filling of the developer is facilitated without causing scattering of the developer. For filling the developer, a known auger type filling device is used but another method (means) having a similar function may also be used.

As shown in (c) of FIG. 30, when the developer accommodating member 16 is filled with the developer, the developer accommodating member 16 is bonded at a bonding portion 39*a*. Thus, the respective openings 35*a* and the filling opening 39 of the developer accommodating member 16 in which the developer is accommodated are sealed and therefore the accommodated developer does not leak out of the developer accommodating member 16, so that the developer accommodating member 16 can be treated as a single unit. The bonding of the bonding portion 39*a* of the filling opening 39 for permitting the filling of the developer is made by ultrasonic bonding in this embodiment but may also be made by other bonding methods using heat, a laser and the like. Incidentally, a position and a size of the filling opening 39 for permitting the filling of the developer may appropriately selected correspondingly to shapes and the like of the developer filling device and the (process) cartridge A.

(Effect of Incorporating Developer Accommodating Member in Frame)

By forming the developer accommodating member 16, in which the developer is accommodated, in a bag shape, the developer can be treated as a unit. For that reason, a developer filling step can be separated from a main assembling step (manufacturing line) of the cartridge A. As a result, the developer is prevented from being scattered in the main assembling step (manufacturing line) of the cartridge A, so that maintenance such as cleaning of the manufacturing line can be reduced. By the prevention of the scattering of the developer during the assembling step, it is possible to omit a cleaning step of the cartridge A to be performed after the developer filling.

Also in the filling step of the developer in the developer accommodating member 16, the developer accommodating member 16 has flexibility, and thus the filling opening 39 for permitting the developer filling is also soft and therefore can be easily sealed with less scattering of the developer.

Further, the developer accommodating member 16 in which the developer is accommodated has flexibility and therefore can be assembled while following a shape of the frame.

Further, in the filling step, the developer accommodating member 16 has flexibility and therefore deforms its cross section to increase its volume in which the developer can be filled, so that a filling amount can be increased during the filling.

Further, the flexible container 37 before the developer filling has flexibility and thus can be made small (thin), so that a storing space during storage before the filling can be decreased compared with the frame which is a resinous structure.

(Structure of Developer Accommodating Member 16)

In this embodiment, as the flexible container, the developer accommodating member 16 is used. Here, referring again to FIG. 3, description will be made.

As shown in FIG. 3, the developer accommodating member 16 in this embodiment is constituted by a molded portion 16*a* which is a flexible container formed by the vacuum molding, the air-pressure molding and the press molding and constituted by a sheet-like air permeable portion 16*b*. The molded portion 16*a* and the air permeable portion 16*b* are bonded by (heat) welding, laser welding, adhesive bonding, adhesive tape bonding or the like. The developer accommodating member 16 accommodated therein the developer and has a flexible shape, and is provided with the plurality of openings 35*a*, for permitting discharge of the accommodated developer, at the discharging portion 35. Further, the developer accommodating member 16 includes the fixing portions (portions-to-be-fixed) 16*d* and 16*e* which are fixed to the frames 17 and 18.

The molded portion 16*a* is formed in a shape close to a hat-like shape (trapezoidal configuration) and includes an upper bottom side 16*j*, a perpendicular side 16*g* and the opening-containing side X (tapered portion). From the perpendicular side 16*g*, an outer peripheral side 16*c*1 is extended upward vertically, and from the opening-containing side X, an outer peripheral side 16*c*2 is extended downward vertically. The outer peripheral sides 16*c*1 and 16*c*2 are bonded to the air permeable portion 16*b*. Further, at the outer peripheral side 16*c*2, fixing portions 16*d* to be fixed to the frame 18 are formed. The shape of the molded portion 16*a* follows the inside shape of the frames 17 and 18 (FIG. 3).

On the developer accommodating member 16, the sealing member 19 for closing and unsealing the openings 34*a* of the discharging portion 35 is mounted. The sealing member 19 is mounted on one side of the rotatable member 20.

Part (a) of FIG. 18 is a partly enlarged sectional view showing a structure of the developer accommodating unit 25, and corresponds to a sectional view as seen from an arrow R2 direction of (b) of FIG. 18. Part (b) of FIG. 18 corresponds to a sectional view as seen from an arrow R2 direction of (a) of FIG. 18, and a broken line portion of (a) of FIG. 18 corresponds to a broken line portion of (b) of FIG. 18. As shown in (b) of FIG. 18, the opening-containing side X on which the self-weight of the developer filled in the developer accommodating member 16 is exerted is formed in a projection shape projected upward with respect to the vertical direction. This projection shape is formed in a shape and that the opening-containing side X is recessed from a phantom plane connecting supporting points 16*p* and 16*q*. Further, the opening-containing side X is, as shown in (a) of FIG. 18, formed so that the bent portion 16*r* extends in a single rectilinear line shape parallel to a shaft of the rotatable member 20 as seen from a side surface. The first side X1 is formed in a flat plane parallel to the shaft of the rotatable member 20 as seen from the side surface. The second side X2 is formed in a flat plane parallel to the shaft of the rotatable member 20 as seen from the side surface.

Part (c) of FIG. 18 is a partly enlarged sectional view showing a structure of a developer accommodating unit according to Comparison example, and corresponds to a sectional view as seen from an arrow R2 direction of (d) of FIG. 18. Part (d) of FIG. 18 corresponds to a sectional view as seen from an arrow R2 direction of (c) of FIG. 18, and a broken line portion of (c) of FIG. 18 corresponds to a solid line portion connecting the supporting points 16*p* and 16*q* in (d) of FIG. 18. As shown in (c) and (d) of FIG. 18, in the developer accommodating member in Comparison example, the opening-containing side X is not provided with the bent portion 16*r*, and is formed in a rectilinear line shape from the supporting point 16*p* to the supporting point 16*q* as seen from a sectional surface.

The reason why the opening-containing side X is strong against the flexure by providing the bent portion 16*r* to the opening-containing side X as in this embodiment will be described below. As shown in (d) of FIG. 18, in the case where the opening-containing side X does not include the bent portion 16*r*, it would be considered that the opening-containing side X is a both end support beam supported at the supporting point 16*p* fixed to the air permeable portion 16*b* and the supporting point 16*q* fixed to the upper bottom portion 16*j*. As shown in (b) of FIG. 18, in the case where the opening-containing side X includes the bent portion 16*r*, in the opening-containing side X, the bent portion 16*r* constitutes a supporting point fixed to sides 16*h* and 16*i*, so that when such a bent portion 16*r* is provided, the supporting points are three in total and thus the strength (stiffness) of the beam is increased.

Here, in this embodiment, the case where the developer inside the developer accommodating member 16 is discharged and thus the developer remaining in the developer accommodating member 16 becomes small in amount will be described. Most of the developer remaining in the developer accommodating member 16 is present on the opening-containing side X. The developer remaining on the opening-containing side X is moved toward the openings 35*a* along the surface of the opening-containing side X, and is discharged while being moved toward the neighborhood of the openings 35*a* by vibration generated when the urging member 500 contacts the developer accommodating member 16. Further, when the amount of the developer remaining in the developer accommodating member 16 becomes small, the developer is gradually placed in a state in which the developer remains on the opening-containing side X at a position closer to the openings 35*a*.

In order to create such a state, as shown in (b) of FIG. 18, with the position closer to the openings 35*a*, a degree of inclination of the first and second sides X1 and X2 with respect to the direction of gravitation is increased. Specifically, shapes of the first and second sides X1 and X2 are set so that the downward inclination with respect to the vertical direction is more abrupt in the second side X2 passing through the supporting points 16*r* and 16*q* than in the first side X1 passing through the supporting points 16*r* and 16*q*, so that a two-stage inclination constitution is employed. Further, a constitution in which even when the amount of the developer remaining inside the developer accommodating member 16 becomes small, the developer is easily discharged is employed. Incidentally, the openings 35*a* are disposed below the bent portion 16*r* with respect to the vertical direction.

Part (e) of FIG. 18 is a partly enlarged sectional view showing a structure of a developer accommodating unit according to a modified embodiment, and corresponds to a sectional view as seen from an arrow R2 direction of (f) of FIG. 18. Part (f) of FIG. 18 corresponds to a sectional view as seen from an arrow R2 direction of (e) of FIG. 18, and a broken line portion of (e) of FIG. 18 corresponds to a solid line portion connecting the supporting points 16*p* and 16*q* in (f) of FIG. 18. This modified embodiment is characterized in that a groove 16*t* vertically recessed upward from the opening-containing side X is formed. This groove 16*t* is, in (f) of FIG. 18, as indicated by a broken line, formed in an upward projection shape with respect to the vertical direction (see also (g) of FIG. 18). Also by such a groove 16*t*, the stiffness of the opening-containing side X is increased.

Part (g) of FIG. 18 is a sectional view showing a structure of an opening-containing side X according to the modified embodiment, and corresponds to a sectional view as seen from an arrow R3 direction of (e) of FIG. 18. In the case where such a single groove 16*t* as described above is provided to the opening-containing side X, in addition to an intersection between the side 16*h* and the groove 16*t* and an intersection between the opening-containing side X and the groove 16*t*, a portion functioning as the beam is newly increased. For that reason, the stiffness of the opening-containing side X is increased.

Parts (h), (i) and (j) of FIG. 18 are sectional views each showing a structure of an opening-containing side X according to a further modified embodiment. In (h) of FIG. 18, an X-shaped groove 16*t* is formed in the opening-containing side X.

In (i) of FIG. 18, a plurality of grooves 16*t* extending in an axial direction of the rotatable member 20 is formed in the opening-containing side X. In (j) of FIG. 18, square grooves 16*t* are formed in the opening-containing side X so that two square grooves 16*t* arranged in the axial direction of the rotatable member 20 with a predetermined interval with respect to a direction perpendicular to the axial direction and so that three square grooves 16*t* are arranged in the direction perpendicular to the axial direction with a predetermined interval with respect to the axial direction. As a result, the six square grooves 16*t* are formed in total. These grooves are not necessarily formed with the predetermined intervals and in a limited number, but it would be considered that the same effect can be obtained by forming the plurality of grooves in such a manner. In the case where the various uneven shapes as described above are provided, the same effect can be obtained.

When the recessed portion as seen from the inside of the developer accommodating member 16 is provided in the opening-containing side X, the developer is liable to remain, and therefore it is desirable that such a recessed portion is not provided. However, even when the recessed portion with respect to the vertical direction is provided, if the recessed portion has a groove shape descending toward the openings 35*a*, the developer can be moved and therefore there is no problem.

By forming the molded portion 16*a* through the vacuum molding, the following effects are obtained.

As a first effect, the developer accommodating member 34 can be shaped so as to follow the inside shape of the frame. For that reason, it is possible to dispose the bag until corner portions of the frame, so that a space (spacing) is prevented from being formed between the developer accommodating member 16 and the frame 17 and thus the space does not constitute a dead space.

As a second effect, the developer accommodating member 16 can be shaped so as to follow the shape of the frame and therefore can be easily assembled with the frame. This is because there is no need to push the developer accommodating member into the frame during the assembling so that its shape follows the shape of the frame.

As a third effect, control of the thickness and shape of each of the molded sides depending on molding shape and condition becomes easy. As a result, it becomes possible to control the stiffness of the side containing the openings 35*a* by providing the uneven shape to the side containing the openings 35*a* as in this embodiment.

(Positional Relationship Between Rotatable Member and Developer Accommodating Member)

Part (b) of FIG. 3 is a partial sectional view showing a structure of the developer accommodating unit 25. As shown in (b) of FIG. 3, in this embodiment, in order to downsize the developer accommodating unit 25, a positional relationship between the rotatable member 20 and the developer accommodating member 16 is set. Specifically, a part of the rotatable member 20 is disposed at a position closer to the opening-containing side X than the phantom plane connecting the supporting points 16*p* and 16*q*. That is, the rotatable member 20 is disposed such that the part thereof enters the recessed portion formed by the opening-containing side X.

This is a result that the constitution in which the opening-containing side X is provided with the bent portion 16*r* and thus is stronger against the flexure than the case where the opening-containing side X is not provided with the bent portion 16*r*. That is, even when the rotatable member 20 is disposed in the neighborhood of the opening-containing side X, the stiffness of the opening-containing side X is increased and therefore a phenomenon that the opening-containing side X is flexed by the weight of the developer filled inside the developer accommodating member 16 is suppressed. Accordingly, there is no need to take into consideration a risk such that all the loads of the developer are exerted on the rotatable member 20.

If the above positional relationship is se based on the premise that the risk occurs, in order not to cause loss of synchronism of the stepping motor of the image forming apparatus due to generation of an excessive torque in the rotatable member 20, there is a need to dispose the developer accommodating member 16 and the rotatable member 20 with a large spacing. For that reason, the developer accommodating unit is increased in size.

Part (c) of FIG. 3 is a partial sectional view showing a structure of the developer accommodating unit 25. As shown in (c) of FIG. 3, the case where the width of the developer accommodating member 16 is larger than the width of the developer accommodating unit 25 (i.e., the spacing between the frames 17 and 18) with respect to the horizontal direction is assumed. In this case, the developer accommodating member 16 has the flexibility and therefore the developer accommodating member 16 is fixed inside the developer accommodating unit 25 in a state in which the upper bottom portion 16*j* is deformed by the frame 17. In this case, the supporting points 16*p* and 16*s* functions as a supporting point of the developer accommodating member 16, and by providing an uneven shape to a phantom plane connecting the supporting points 16*p* and 16*s*, an effect of being strong against the flexure is similarly obtained.

(Material and Air Permeability of Developer Accommodating Member)

Part (a) of FIG. 29 is a sectional view for illustrating the structure of the developer accommodating member 16 and the sealing member 19. The developer accommodating member 16 is constituted by bonding the molded portion 16*a* which includes the openings 35*a* and which does not have air permeability, and the sheet-like air permeable portion 16*b* which has the air permeability and which is an air permeable portion to each other.

Here, a degree of the air permeability of the sheet-like air permeable portion 16*b* which is the air permeable portion may appropriately be selected so that the developer is prevented from leaking out of the developer accommodating member 16 based on a balance with a size of the developer (particle size of powder) to be accommodated.

As the material for the molded portion 16*a*, materials such as ABS, PMMA, PC, PP, PE, HIPS, PET, PVC and composite multi-layer materials of these materials may preferably be used. The thickness of the molded portion 16*a* in the sheet shape before the molding may preferably be about 0.1-1 mm. The material and thickness of the molded portion 16*a* may appropriately be selected depending on cost, product specification, manufacturing condition, and the like.

As a material for the sheet-like air permeable portion 16*b*, a nonwoven fabric or the like formed of polyethylene telephthalate (PET), polyethylene (PE), polypropylene (PP) or the like in a thickness of 0.03-0.15 mm may preferably be used. Further, even when the material for the sheet-like air permeable portion 16*b* is not the nonwoven fabric, a material having minute holes which is smaller in diameter than the powder such as the developer accommodated in the developer accommodating member 16 may also be used.

Further, in this embodiment, as shown in FIGS. 3 and 29, the sheet-like air permeable portion 16*b* is disposed over the entire region of the developer accommodating member 16 with respect to a longitudinal direction in the frame 18 side. As shown in (b) of FIG. 29, the sheet-like air permeable portion 16*b* may also constitute the entire developer accommodating member 16.

As a material for the developer accommodating member 16 other than the sheet-like air permeable portion 16*b*, a material having flexibility so as to improve an efficiency during the discharge of the developer described later may preferably be used. Further, the material for the air sheet-like air permeable portion 16*b* may also have flexibility.

(Effect of Developer Accommodating Member Having Air Permeability)

The reason why the air permeability is imparted to the developer accommodating member 16 as described above is that the developer accommodating member 16 can meet states during manufacturing, during transportation until a user uses the cartridge A, and during storage. First, the reason for the state during the manufacturing is that the developer accommodating member 16 is made deformable and reducible in order to facilitate assembling the developer accommodating member 16 with the frames 17 and 18. In the case where the developer accommodating member 16 is not provided with the sheet-like air permeable portion 16*b*, the size thereof cannot be changed from that in a state in which the developer accommodating member 16 is filled with the developer (the bag is closed) and therefore the developer accommodating member 16 is not readily deformed. For that reason, it takes time to assembly the developer accommodating member 16 and the step is complicated. Therefore, when the air permeability is imparted to at least a part of the developer accommodating member 16, the size of the developer accommodating member 16 can be changed from that in the state in which the developer accommodating member 16 is filled with the developer and then is closed, thus facilitating the assembling of the developer accommodating member 16.

Next, the reason for the states during the transportation and during the storage is that the developer accommodating member 16 can meet a change (difference) in air pressure between the inside and outside of the developer accommodating member 16 during the transportation and during the storage of the cartridge A. The difference in air pressure between the inside and outside of the developer accommodating member 16 is generated in the case where the developer accommodating member 16 is in a lower air-pressure environment during the transportation or the like than during the manufacturing or in the case where the developer accommodating member 16 is stored at a higher temperature than during the manufacturing. For that reason, by expansion of the developer accommodating member 16, there is a possibility that parts contacting the developer accommodating member 16 are deformed or broken. Therefore, there is a need to control the air pressure and the temperature during the transportation and during the storage, so that facilitates for that purpose are required and a cost is increased. However, problems caused due to the difference in air pressure between the inside and outside of the developer accommodating member 16 can be solved by partly imparting the air permeability to the developer accommodating member 16.

Further, in the case where the nonwoven fabric is provided with the discharging portion 35 and bonding portions 22 (22*a*, 22*b* in FIG. 4) at a periphery of the discharging portion 35, there is a possibility that fibers of the nonwoven fabric fall out with peeling of the sealing member 19 during unsealing and then enter the developer to adversely affect the image. For that reason, the discharging portion 35 is provided to the molded portion 16*a* different from the sheet-like air permeable portion 16*b* having the air permeability, so that the above-described falling-out of the fibers from the nonwoven fabric is prevented. Further, a filling density can be increased by filling the developer while deaerating the developer accommodating member bag 16.

(Structure of Discharging Portion of Developer Accommodating Member)

As shown in FIG. 10, the developer accommodating member 16 includes the discharging portion 35. The discharging portion 35 is provided at the molded portion 16*a* and includes the openings 35*a* and the connecting portions 35*b*. The openings 35*a* are provided at a plurality of positions of the discharging portion 35 of the developer accommodating member 16 and are configured to permit the discharge of the inside developer. The connecting portions 35*b* connect the plurality of openings 35*a* and define an outer configuration of the developer accommodating member 16.

Further, the discharging portion 35 is continuously surrounded by the bonding portion 22 to be bonded in an unsealable state, so that the developer accommodated in the developer accommodating member 16 is sealed with the sealing member 19.

(Structure of Bonding Portion of Developer Accommodating Member)

The bonding portion 22 has a rectangular shape consisting of two lines extending in a long direction (arrow F direction) and two lines extending in a short direction (arrow E direction) so as to surround the discharging portion 35 and therefore the bonding portion 22 enables the sealing of the discharge portion 35.

Here, of the two lines of the welded bonding portion 22 extending in the long direction (arrow F direction), a bonding portion which is first unsealed is referred to as a first bonding portion 22*a* and a bonding portion which is unsealed later is referred to as a second bonding portion 22*b*. In this embodiment, in the case where the bonding portion 22 is viewed along the surface of the sealing member 19, a bonding portion closer to a fold-back portion 19*d* (FIG. 12) (or engaging portion 19*b*) described later is the first bonding portion 22*a*. Further, a bonding portion opposing the first bonding portion 22*a* via the opening 35*a* is the second bonding portion 22*b*. Further, a bonding portion with respect to a widthwise direction (arrow E direction) is a widthwise bonding portion 22*c*.

In this embodiment, an unsealing direction is the arrow E direction. The unsealing direction is defined as follows. In the case where the unsealing is effected by moving the sealing member 19, of the first bonding portion 22*a* and the second bonding portion 22*b* opposing to each other via the openings 35*a*, the first bonding portion 22*a* is first unsealed (peeled). Thus, a direction directed from the first bonding portion 22*a* to be first unsealed toward the second bonding portion 22*b* is the unsealing direction (arrow E direction).

When the sealing member 19 is unsealed (peeled) from the developer accommodating member 16 in the arrow E direction, in some cases, the peeling microscopically progresses also in the arrow F direction due to the deformation of the developer accommodating member 16 by an unsealing force also in the first bonding portion 22*a* and in the second bonding portion 22*b*. However, the unsealing direction in this embodiment does not refer to such a microscopic unsealing direction.

(Disposition of Openings of Developer Accommodating Member)

Next, disposition of the openings 35*a* will be described with reference to FIGS. 10, 11 and 30. The movement direction (in which the sealing member 19 is pulled by the rotatable member 20) of the sealing member 19 for sealing the openings 35*a* and for exposing the openings 35*a* by being moved is an arrow D direction. By the movement of the sealing member 19, the exposure of the openings 35*a* progresses in the unsealing direction (arrow E direction). In the following, the movement direction of the sealing member 19 is the arrow D direction. The plurality of openings 35*a* and the plurality of connecting portions 35*b* are alternately disposed along the arrow F direction (FIG. 10) perpendicular to the unsealing direction (arrow E direction). Further, the sealing member 19 is configured to be wound up by rotating the rotatable member 20 but the arrow F direction is the same direction as an axis (shaft) of the rotatable member 20.

The reason why the rotational axis direction of the developing roller 13 and the arrow F direction in which the plurality of openings 35*a* are arranged are and made equal is that the developer is easily supplied, during the discharge thereof, to the developing roller 13 over the entire longitudinal direction without being localized.

The plurality of openings 35*a* are shifted and disposed along the arrow F direction and therefore the discharging portion 35 is long in the arrow F direction and is short in the arrow E direction. That is, with respect to the arrow F direction, a distance from an end to another end of the plurality of openings 35*a* is longer than that with respect to the arrow E direction.

Thus, the discharging portion 35 where the plurality of openings 35*a* are shifted and disposed in the rotational axis direction (arrow F direction) perpendicular to the unsealing direction (arrow E direction) is long in the arrow F direction and is short in the arrow E direction. For that reason, the distance required for the unsealing can be made shorter than that required for the unsealing in the long direction (arrow F direction) and therefore a time required for the unsealing can also be made short.

Further, a constitution in which the sealing member 19 for covering the discharging portion 35 is wound up by the rotatable member 20 is employed. The rotational axis direction of the rotatable member 20 and the arrow F direction substantially perpendicular to the unsealing direction (arrow E direction) are made equal, so that winding distance and time of the sealing member 19 can be shortened.

(Shape and Direction of Openings of Developer Accommodating Member)

Each of the plurality of openings 35*a* in this embodiment has a circular shape. When a discharging property is taken into consideration, an area of the openings 35*a* may preferably be large. Further, the connecting portions 35*b* defining the openings 35*a* may preferably be large (thick) in order to enhance the stiffness of the developer accommodating member 16. Therefore, the area of the openings 35*a* and the area of the connecting portions 35*b* are required to achieve a balance in view of a material and a thickness of the discharging portion 35 and a force relationship with peeling strength during the unsealing described later and may be appropriately selected. The shape of each opening 35*a* may also be, in addition to the circular shape, a polygonal shape such as a rectangular shape, an elongated circular shape, and the like shape.

The arrangement of the openings 35*a* may only be required to be such that the openings 35*a* are shifted (spaced) with respect to the arrow F direction perpendicular to the unsealing direction (arrow E direction). Constitutions shown in (a) and (b) of FIG. 28 may be carried out but the present invention is not limited thereto. Even when the adjacent openings 35*a* overlap with each other, as shown in (c) of FIG. 28, as seen in the arrow F direction perpendicular to the unsealing direction (arrow E direction) or do not overlap with each other, as shown in (d) of FIG. 28, as seen in the arrow F direction, an effect of the connecting portions 35*b* described later is achieved.

Further, the direction of the openings 35*a* may preferably be such that the developer accommodated in the developer bag 16 is easily discharged in an attitude during image formation. For that reason, in the attitude during image formation, the openings 35*a* are disposed so as to be open downward with respect to the gravitational direction. The state in which the openings 35*a* open downward with respect to the gravitational direction refers to that the direction of the openings 35*a* has a downward component with respect to the gravitational direction.

(Fixing Between Developer Accommodating Member and Frame)

With reference to FIGS. 3 and 4, the following constitution will be described. As shown in FIGS. 3 and 4, the developer accommodating member 16 is fixed inside the frame 17 and the frame 18 by the two types of fixing portions 16*d* and 16*e*.

(First Fixing Portion)

First, as a first fixing portion, the first fixing portion 16*d* of the developer accommodating member 16 where a force is received when the sealing member 19 is unsealed (removed) from the developer accommodating member 16 as described later is provided. The first fixing portion 16*d* is provided at a plurality of positions in parallel to the arrow F direction along which the plurality of openings 35*a* are arranged. Different from the arrangement at the plurality of positions, the first fixing portion 16*d* may also be a single fixing portion elongated in parallel to the arrow F direction (not shown).

The first fixing portion 16*d* is positioned in the neighborhood of the openings 35*a* of the developer accommodating member 16.

The first fixing portion 16*d* of the developer accommodating member 16 is fixed to a first fixing portion 18*a* of the frame 18.

The first fixing portion 16*d* is a fixing portion necessary for the time of unsealing the developer accommodating member 16, and its action and arrangement will be described later in the description of the unsealing.

(Second Fixing Portion)

Further, as a second fixing portion, the second fixing portion 16*e* for preventing movement of the developer accommodating member 16 downward or toward the developing roller 13 and the developer supplying roller 23 is provided.

The second fixing portion 16*e* is provided for the following two reasons. A first reason is that the second fixing portion 16*e* of the developer accommodating member 16 is prevented from moving the developer accommodating member 16 downward in the attitude during the image formation. For that reason, the second fixing portion 16*e* may preferably be disposed at an upper position in the attitude during the image formation.

Further, a second reason is that the developer accommodating member 16 is prevented from disturbing the image in contact with the developing roller 13 and the developer supplying roller 23 during the image formation. For that reason, the second fixing portion 16*e* of the developer accommodating member 16 may preferably be provided at a position remote from the developing roller 13 and the developer supplying roller 23. In this embodiment, the second fixing portion 16*e* of the developer accommodating member 16 is disposed at an upper position remote from the developing roller 13 as shown in FIG. 4.

The second fixing portion 16*e* of the developer accommodating member 16 is fixed to a second fixing portion 18*b* of the frame 18.

<Fixing Method Between Developer Accommodating Member and Frame>

(Fixing Method of First Fixing Portion)

Parts (a) to (d) of FIG. 27 are sectional views for illustrating a step for fixing the developer accommodating member 16 to the frame 18. As a fixing method of the first fixing portion 16*d* of the developer accommodating member 16, fixing by ultrasonic clamping such that a boss of the second frame 18 is passed through the hole of the developer accommodating member 16 to be deformed is used. As shown in (a) of FIG. 27, before fixing, the first fixing portion 18*a* of the frame 18 has a cylindrical boss shape, and the first fixing portion 16*d* of the developer accommodating member 16 has a hole which is open. An assembling step is described below.

First, as shown in (b) of FIG. 27, a projected portion of the first fixing portion 18*a* of the second frame 18 is passed through the hole of the first fixing portion 16*d* of the developer accommodating member 16.

Then, as shown in (c) of FIG. 27, an end of the first fixing portion 18*a* of the frame 18 is fused by a ultrasonic clamping tool 91.

Then, as shown in (d) of FIG. 27, the end of the first fixing portion 18*a* of the frame 18 is deformed so that it is larger than the hole of the first fixing portion 16*d* of the developer accommodating member 16, and thus the developer accommodating member 16 is fixed to the frame 18.

(Fixing Method of Second Fixing Portion)

As shown in FIG. 4, as a fixing method of the second fixing portion 16*e* of the developer accommodating member 16, clamping by the two frames 17 and 18 is used. Holes are made in the developer accommodating member 16 to constitute the first fixing portion 16*e* of the developer accommodating member 16, and projections are provided to the second frame 18 to constitute the second fixing portion 18*b* of the frame.

An assembling step is as follows. Projections of the second fixing portions 18*b* of the frame 18 are passed through the second fixing portions 16*e* of the developer accommodating member 16, and then the developer accommodating member 16 is clamped by the frame 17 so that the second fixing portions 16*e* (holes) of the developer accommodating member 16 are not disengaged (dropped) from the projections to be fixed.

Incidentally, the developer accommodating member 16 is formed by the vacuum molding, and therefore the developer accommodating member 16 itself will keep its shape and the developer accommodating member 16 has a shape along the frames, so that the developer accommodating member 16 is supported by the frames as a whole. Therefore, it is possible to omit the second fixing portion for preventing (limiting) the movement of the developer accommodating member 16 toward the supplying roller 23 and the developing roller 13 as described in this embodiment.

(Other Fixing Means)

As other fixing means, different from the above-described ultrasonic clamping, it is also possible to use fixing means using ultrasonic wave. For example, heat clamping using heat, (heat) welding or ultrasonic welding for directly welding the developer accommodating member 16 to the frame 17 or the frame 18, bonding using a solvent or an adhesive, insertion of the developer accommodating member 16 between the frames, hooking using the heat clamping, the ultrasonic clamping, a screw, or a combination of holes and projections (such as bosses), and the like means may also be used. Further, the developer accommodating member 16 may also be fixed via a separate member provided between the frames 17 and 18 depending on appropriate design based on relationships in space, arrangement or the like between the developer bag 16 and the frames 17 and 18 (not shown).

<Structure of Sealing Member>

As shown in FIGS. 3 and 4, the sealing member 19 covers the discharging opening 35 of the developer accommodating member 16 before use of the cartridge A, thus confining the developer in the developer accommodating member 16. The sealing member 19 is moved, so that the openings 35*a* are exposed. The sealing member 19 is constituted by a sheet-like sealing member including a sealing portion 19*a* for covering (sealing) the discharge portion 35 of the developer accommodating member 16, an engaging portion 19*b* to be fixed (engaged) with the rotatable member 20 described later, and a connecting portion 19*c* which connects the sealing portion 19*a* and the engaging portion 19*b*. The sheet-like sealing member is formed of a laminate material having a sealant layer which exhibits an easy-unsealing property described later, and a base material therefor is polyethylene telephthalate (PET), polyethylene, polypropylene or the like. A thickness of the sheet-like sealing member may appropriately be set in a range of 0.03-0.15 mm.

(Sealing Portion of Sealing Member)

A sealing portion 19*a* refers to a region where the sealing member 19 seals the plurality of openings 35*a* and connecting portions 35*b* of the developer accommodating member 16. By the sealing portion 19*a*, the developer is prevented from being leaked from the inside of the developer accommodating member 16 until before use of the cartridge A.

(Engaging Portion of Sealing Member)

The sealing member 19 has a free end portion in one end side thereof with respect to the unsealing direction (arrow E direction), and at the free end portion, the engaging portion 19*b* to be engaged with the rotatable member 20 for moving the sealing member 19 is provided. The engaging portion 19*b* as an end portion of the sealing member 19 for exposing the openings 35*a* is engaged with the rotatable member 20. The sealing member 19 may also be configured to be automatically subjected to the unsealing (pealing) by receiving a driving force from the image forming apparatus main assembly B. Or, the sealing member 19 may also be configured to be subjected to the unsealing (peeling) by being held and moved by the user. In this embodiment, the rotatable member 20 is a rotation shaft provided in the frame, and the sealing member 19 engaged with the rotatable member 20 is pulled, so that the developer accommodating member 16 accommodating the developer is unsealed.

(Connecting Portion of Sealing Member)

A portion connecting the bonding portion 22 and the engaging portion 19*b* is the connecting portion 19*c* (FIG. 3). The connecting portion 19*c* is a portion for transmitting a force so as to pull off the bonding portions 22 (22*a*, 22*b*) by receiving the force from the rotatable member 20.

(Folding-Back of Connecting Portion)

Referring to FIG. 12, a plane formed between the first bonding portion 22*a* and the second bonding portion 22*b* at the movement of the unsealing is taken as N1. A plane which is perpendicular to the plane N1 and which passes through the first bonding portion 22*a* is taken as N2.

The rotatable member 20 is disposed closer to the second bonding portion 22*b* than the plane N2 passing through the first bonding portion 22*a*. In other words, the sealing member 19 includes when it is seen along the surface of the sheet-like sealing member 19, a fold-back portion 19*d* where the sealing member 19 is folded back at the portion (connecting portion 19*c*) between the connecting portion 22 and the engaging portion 19*b* engaged with the rotatable member 20. The fold-back portion 19*d* may be provided with or not provided with a fold (crease). A folding angle Q of the sealing member 19 may preferably be 90 degrees or less. The folding angle Q is an angle Q between a plane of the bonding portion 22 of the developer accommodating member 16 and a plane along the arrow D direction in which the sealing member 19 is pulled.

(Fixing of Sealing Member)

Further, fixing between the sealing member 19 and the rotatable member 20 is, in this embodiment, made by the ultrasonic clamping similarly as in the case of the first fixing portion 16*d*. Other than the ultrasonic clamping, the fixing may also be made by the (heat) welding, the ultrasonic welding, the bonding, the insertion between the frames, the hooking by a hole and a projection, or the like similarly as the means for fixing the first fixing portion 16*d* and the second fixing portion 16*e*.

(Portion Having Easy-Unsealing Property of Sealing Member)

A method of providing a peeling force of the bonding portion 22 with a desired value will be described. In this embodiment, in order to provide the peeling force with the desired value (a minimum force within a range in which the toner sealing property can be maintained), two methods are principally employed.

In a first method, a laminate material having a sealant layer for enabling easy unsealing of the sealing member is applied. Further, the first method is a method in which the easy unsealing is enabled at the bonding portion by using, as the material for the developer accommodating member 16, a sheet material (of, e.g., polyethylene or polypropylene) which is weldable with the sealant layer and which has flexibility. By changing a combination of formulation of the sealant layer with the material to be bonded, the peeling force can be adjusted correspondingly to a desired condition. In this embodiment, a material having a peeling strength of about 3N/15 mm measured by testing methods for heat sealed flexible packages (JIS-Z0238) is used.

A second method is a method in which as shown in FIGS. 4 and 7, the discharging portion 35 of the developer accommodating member 16 is placed in a state in which the sealing member 19 is folded back with respect to an unsealing direction (arrow E direction). For example, in the state of FIG. 4, the rotatable member 20 is rotated in the rotational direction (arrow C direction), so that the sealing member 19 is pulled in a pulling direction (arrow D direction) by the rotatable member 20. As a result, the developer accommodating member 16 and the sealing member 19 provide an inclined peeling positional relationship, as shown in FIG. 12, in which the angle Q between the plane of the bonding portion 22 of the developer accommodating member 16 and the plane along the pulling direction (arrow D direction) of the sealing member 19 is 90 degrees or more. It has been conventionally known that the peeling force necessary to separate the both surfaces can be reduced by establishing the inclined peeling positional relationship. Therefore, as described above, the discharging portion 35 is placed in the state in which the sealing member 19 is folded back with respect to the unsealing direction (arrow E direction), so that the sealing member 19 of the bonding portion 22 and the developer accommodating member 16 are placed in the inclined peeling positional relationship and thus the peeling force can be adjusted so as to be reduced.

<Structure of Unsealing Member>

The rotatable (unsealing) member 20 is used for the purpose of peeling the sealing member 19 from the developer accommodating member 16 by applying a force to the sealing member 19 to move the sealing member 19. The rotatable member 20 includes a supporting portion (not shown) which has a shaft shape and which is rotatably supported by the second frame 18 at its ends, and includes an engaging portion 20*b* to which the engaging portion 19*b* of the sealing member 19. In this embodiment, the rotatable member 20 has a rectangular shaft shape, and the engaging portion 19*b* of the sealing member 19 is engaged with the engaging portion 20*b* at one of four sides of the rectangular shaft.

(Combined Use as Unsealing Member, Urging Member and Stirring Member)

The urging sheet 21 for externally acting on the developer accommodating member 16 to discharge the developer accommodated in the developer accommodating member 16, and the rotatable member 20 may be separate members but in this embodiment, the same part performs functions of the rotatable member 20 and the urging sheet 21.

Further, a function of stirring the developer discharged from the developer accommodating member 16 and a function of the rotatable member 20 may be performed by separate members but in this embodiment, the rotatable member 20 also perform the stirring function of the stirring member.

(Effect of Combined Use as Unsealing Member, Urging Member and Stirring Member)

Thus, by using the same part (member) as the rotatable member 20, the urging sheet 21 and the stirring member, the number of parts is reduced, so that it becomes possible to realize cost reduction and space saving.

<Summary of Unsealing of Developer Accommodating Member (Bag)>

The unsealing of the developer accommodating member (developer accommodating bag) 16 will be described with reference to FIGS. 7 and 8.

For unsealing the developer accommodating member 16, the developer accommodating unit 25 includes a power application point portion 20*a* where the rotatable member 20 applies the force for pulling the sealing member 19, and includes the fixing portion 18*a* of the frame for fixing the developer accommodating member 16 to be pulled.

The power application point portion 20*a* is a portion, closest to the bonding portion 22, of a portion where the sealing member 19 and the rotatable member 20 contact at the moment of the unsealing. In (b) of FIG. 7, a corner portion 20*c* of the rotatable member 20 constitutes the power application point portion 20*a*. The fixing portion 18*a* of the frame 18 includes a fixing portion 18*c* for suppressing movement of the developer accommodating member 16 caused by the force during the unsealing. In this embodiment, from the bonding portion 22, the first fixing portion 18*a* of the frame 18 and the first bonding portion 16*d* of the developer accommodating member 16 are bonded to each other by the ultrasonic clamping. As shown in (b) and (c) of FIG. 7 and (a) of FIG. 8, a portion, closer to the bonding portion 22, of the first fixing portion 18*a* bonded by the ultrasonic clamping constitutes the fixing portion 18*c*.

As shown in FIG. 4, the rotatable member 20 is rotated in the arrow C direction by transmission of the during force thereto by an unshown driving means provided to the apparatus main assembly B.

A state immediately before the sealing member 19 is pulled by further rotation of the rotatable member 20 to start the unsealing is shown in FIG. 5 and (c) of FIG. 7. With the rotation, the sealing member 19 fixed to the rotatable member 20 by the engaging portion 19*b* is pulled in the arrow D direction by the corner portion 20*c* (power application point portion 20*a*) of the rectangular rotatable member 20.

When the sealing member 19 is pulled, the developer accommodating member 16 is pulled via the bonding portion 22. Then, a force is applied to the first fixing portion 16*d* of the developer accommodating member 16, so that the developer accommodating member 16 is pulled from the fixing portion 18*c* toward the power application point portion 20*b* by the fixing portion 18*c*. Then, in a cross section perpendicular to the rotation shaft of the rotatable member 20, the first bonding portion 22*a* is moved to approach a line connecting the power application point portion 20*a* and the fixing portion 18*c*. At this time, with respect to the arrow D direction, from a side close to the rotation shaft of the rotatable member 20, the portions are disposed in the order of the openings 35*a*, the first bonding portion 22*a*, the fold-back portion 19*d* and the fixing portion 18*c* ((b) of FIG. 7). Further, the unsealing member 19 is folded back between the first bonding portion 22*a* and the engaging portion 19*b* and therefore the force is applied to the portion of the first bonding portion 22*a* so as to be inclination-peeled in the arrow D direction. Then, the peeling of the first bonding portion 22*a* is effected to start the unsealing of the discharging portion 35.

Together with the corner portion 20*c*, also the power application point portion 20*a* is moved in the arrow C direction, and when the sealing member contacts a corner portion 20*d*, the power application point portion 20*a* is moved from the corner portion 20*c* to the corner portion 20*d*. Part (b) of FIG. 7 shows a state in which the power application point portion 20*a* is the corner portion 20*c*, and (c) of FIG. 7 shows a state in which the rotatable member 20 in further rotated and thus the power application point portion 20*a* is moved to the corner portion 20*d*.

As shown in FIG. 6 and (c) of FIG. 7, when the unsealing is advanced with further rotation of the rotatable member 20, also the fold-back portion 19*d* is moved in the arrow E direction. Then, the unsealing is further advanced, so that the openings 35*a* are exposed. A state in which the peeling of the second bonding portion 22*b* is to be started after the openings 35*a* are exposed is shown in (a) of FIG. 8. Also at this time, similarly as in the case of the peeling of the first bonding portion 22*a*, the sealing member 19 is pulled toward the power application point portion 20*a*, and the developer accommodating member 16 stands firm toward a direction of the fixing portion 18*c* (an arrow H direction). Then, in a cross section perpendicular to the rotation shaft of the rotatable member 20, the second bonding portion 20*b* is moved to approach a line connecting the power application point portion 20*a* and the fixing portion 18*c*. Then, the force is applied to the portion of the bonding portion 22*b* in the arrow D direction, so that the second bonding portion 22*b* is separated. Thus, the second bonding portion 222*b* is peeled to complete the unsealing ((b) of FIG. 8 and FIG. 9). Then, the developer inside the developer accommodating member 16 is discharged in an arrow I direction through the openings 35*a* of the discharging portion 35.

Thus, the sealing member 19 is wound up around the rotatable member 20 by the rotation of the rotatable member 20, so that the bonding portion 22 is unsealed. The sealing member 19 is wound up by the rotation of the rotatable member 20, and therefore a space required to move the rotatable member 20 may only be required to be a rotation space of the rotatable member 20, and compared with the case where the sealing member 19 is moved by movement other than the rotation, it is possible to realize space saving.

By providing the sealing member 19 with the fold-back portion 19*d*, so that the bonding portion 22 can be inclination-peeled without using shearing peeling and thus can be unsealed with reliability.

Further, the engaging portion 19*b*, to be engaged with the rotatable member 20, for unsealing the sealing member 19 in an end side of the sealing member 19 with respect to a direction substantially perpendicular to the arrow F direction in which the plurality of openings 35*a* are arranged is provided, so that the sealing member 19 can be engaged and unsealed with reliability.

Further, by providing the frame with the fixing portion 18*c*, the developer accommodating member 16 is supported by the frame during the unsealing, so that even a soft and deformable developer accommodating member 16 becomes unsealable with reliability.

With respect to the discharge of the developer during the unsealing, as described above, the bonding portion 22 is moved along the line connecting the power application point portion 20*a* and the fixing portion 18*c* (in the order of (a) of FIG. 7, (b) of FIG. 7, (c) of FIG. 7 and (a) of FIG. 8). By this motion, the developer at the periphery of the openings 35*a* is moved, so that agglomeration of the developer can be broken.

(Positional Relation of Fixing Portion Associated with Unsealing)

As shown in FIG. 4, in order to peel off the first bonding portion 22*b* with reliability, the following positional relation is required between the first bonding portion 22*b* and the fixing portion 18*c*. During the unsealing, with respect to the fixing portion 18*c*, the rotatable member 20 pulls the sealing member 19 in the arrow D direction. At this time, with respect to the movement direction (arrow D direction) of the sealing member 19 by the rotatable member 20, the fixing portion 18*c* is provided upstream of the openings 35*a*. For that reason, a force is applied to the fixing portion 18*c* in the arrow H direction. Therefore, when the unsealing force is applied, the sealing member 19 is pulled in the arrow H direction and the arrow D direction between the fixing portion 18*c* and the rotatable member 20 to apply a force to the first bonding portion 20*a*, thus advancing the unsealing. Thus, when the fixing portion 18*c* is not provided upstream with respect to the movement direction (arrow D direction) of the sealing member 19, the entire developer accommodating member 16 is pulled in the direction in which the sealing member 19 is pulled, so that the force cannot be applied to the first bonding portion 22*a* and thus the first bonding portion 22*a* cannot be unsealed.

In this way, the fixing portion 18*c* is provided upstream with respect to the movement direction (arrow D direction) of the sealing member 19, so that reliable unsealing becomes possible.

(Distance Relation of Fixing Portion Associated with Unsealing)

As shown in FIGS. 22 and 23, in order to peel off the first bonding portion 22*a* with reliability, the following length relationship is required between the first bonding portion 22*a* and the fixing portion 18*c*. First, a point of the first bonding portion 22*a* finally peeled off when a flat plane which passes the rotatable member 20, the openings 35*a* and the fixing portion 18*c* and which is perpendicular to the rotation shaft of the rotatable member 20 is viewed, is taken as a first point 22*d*. The first point 22*d* is an end point of the first bonding portion 22*a* close to the openings 35*a*. A distance from the fixing portion 18*c* to the first point 22*d* along the developer accommodating member 16 is taken as M1. A distance, from the first fixing portion 18*c* to the first point 22*d*, measured along the developer accommodating member 16 with respect to the direction including the openings 35*a* is taken as M2. The openings 35*a* provide a space in which the material for the developer accommodating member 16 is not present but a width of the openings 35*a* is also included in the distance M2.

In this case, a relationship of M1<M2 is satisfied to permit the peeling-off of the first bonding portion 22*a*. The relationship of M1<M2 will be described specifically.

(M1<M2)

First, in the case where M1<M2 is satisfied, as shown in FIG. 22, a force for pulling the sealing member 19 toward the first bonding portion 22*a* (in the arrow D direction) by the rotatable member 20 and a retaining force of the fixing portion (in the arrow H direction) are applied to the first bonding portion 22*a*, so that inclination peeling of the first bonding portion 22*a* can be effected. By effecting the inclination peeling, the peeling force can be set at a low level. Part (a) of FIG. 22 shows a state before the unsealing, and (b) of FIG. 22 shows a state immediately before the first bonding portion 22*a* is unsealed.

(M1>M2)

On the other hand, in the case of M1>M2, as shown in FIG. 23, the pulling force by the rotatable member 20 is not applied to the first bonding portion 22*a* but is applied to the second bonding portion 22*b*. In this case, the force is not applied to the first bonding portion 22*a* and therefore the first bonding portion 22*a* is not peeled. In this case, the force from the rotatable member 20 (in the arrow D direction) and the retaining force of the fixing portion 18*c* (in the arrow H direction) are applied to the second bonding portion 22*b*. In this state, to the second bonding portion 22*b*, the force for pulling the sealing member 19 by the rotatable member 20 (in the arrow D direction) and the retaining force of the fixing portion 18*c* (in the arrow H direction) are applied. At the portion of the second bonding portion 22*b*, the peeling relationship is a shearing peeling relationship and therefore it is difficult to unseal the second bonding portion 22*b*. This is because the shearing peeling requires a large force compared with the inclination peeling.

Part (a) of FIG. 23 shows a state before the unsealing, and (b) of FIG. 23 shows a state when the force for pulling the sealing member 19 by the rotatable member 20 (in the arrow D direction) is applied to the bonding portion (the second bonding portion in this case) by the rotation of the rotatable member 20. To the second bonding portion 22*b*, the force is applied but is applied based on the shearing peeling and therefore compared with the case of the inclination peeling, a very large force is required, so that it becomes difficult to reduce the peeling force.

(Distance in Case where Projection is Present)

Definition of a manner of measuring the above-described distances M1 and M2 will be described. The distances M1 and M2 are important when the sealing member 19 is pulled during the unsealing. In the case where there is no projection (projected connecting portion) 16*t* at an intermediate position of paths of M1 and M2, the distances developed as shown in FIGS. 22 and 23 may only be required to be measured. Further, in the case where there is the projection 16*t* formed, by bonding in manufacturing, at the intermediate position of the paths of M1 and M2, even when the sealing member 19 is pulled during the unsealing, the projection 16*t* is not elongated (peeled off) and therefore the portion of the projection 16*t* is not included in the distances M1 and M2. That is, the portion, such as the projection 16*t*, which does not affect transmission of the force is not included in the distances M1 and M2.

As described above, based on the relationship of M1<M2, the first bonding portion 22*a* is unsealed earlier than the second bonding portion 22*b*. As a result, the fold-back portion 19*d* of the sealing member 19 is provided closer to the first bonding portion 22*a*. By this fold-back portion 19*d*, the peeling is not the shearing peeling but is the inclination peeling. As a result, with reliability, the sealing member 19 can be peeled off from the developer accommodating member 16, so that it is possible to provide an unsealable developer accommodating unit 25.

(Plurality of Fixing Portions)

A relation between a plurality of fixing portions and the unsealing will be described with reference to (a) and (b) of FIG. 31, wherein (a) of FIG. 31 shows a state before the unsealing, and (b) of FIG. 31 shows a state immediately before the rotatable member 20 is rotated from the state of (a) of FIG. 31 to unseal the first bonding portion 22*a*. In this embodiment, the first fixing portion 18*a* and the second fixing portion 18*b* are provided. The force during the unsealing is applied to the first fixing portion 18*a* disposed at a place close to the first bonding portion 22*a*, which is first unsealed, spaced from the second bonding portion 22*b* via the openings 35*a*. For that reason, the second fixing portion 18*b* is not required to be taken into consideration in the measuring manners of the distances M1 and M2 described above. Thus, in the case there are the plurality of fixing portions, the unsealing is effected on the basis of the fixing portion disposed at the place close to the first bonding portion 22*a*, which is first unsealed via the openings 35*a* to which the force during the unsealing is to be applied.

(Positional Relation of Second Bonding Portion)

With reference to FIG. 12 showing a state immediately before the first bonding portion 22*a* is unsealed, an arrangement in which the second bonding portion 22*b* can be more satisfactorily unsealed without being wound up around the rotatable member 20 will be described. First, an end portion of the first bonding portion 22*a* remote from the openings 35*a* is taken as a second point 22*e*. An end portion of the second bonding portion 22*b* remote from the openings 35*a* is taken as a third point 22*f*. A distance from the second point 22*e* to the third point 22*f* is taken as L1. A distance from the second point 22*e* to the power application point portion 20*a* is taken as L2. In this case, the distances L1 and L2 are required to satisfy the relationship of L1<L2.

This is because in the case where L1 is larger than L2, the second bonding portion 22*b* reaches the power application point portion 22*a* before the peeling of the second bonding portion 22*b* is ended, and thus the second bonding portion 22*b* is wound about the rotatable member 20. Therefore, the force cannot be applied so as to peel off the sealing member 19 from the second bonding portion 22*b*. For that reason, it becomes difficult to unseal the sealing member 19 from the developer accommodating member 16.

As described above, the relationship between the distance L1 and L2 is made to satisfy: L1<L2, so that the sealing member 19 is satisfactorily unsealable without being wound about the rotatable member 20.

(Function of Connecting Portions Defining Openings)

A summary of the connecting portions 35*b*, defining the openings 35*a*, which perform a large function in the unsealing operation of the developer accommodating member 16 will be described.

FIG. 11 is a schematic view of the discharging portion 35 when the peeling at the first bonding portion 22*a* to be first unsealed is ended to expose the openings 35*a*, and shows a state in which the peeling at the second bonding portion 22*b* is not ended. As described above, the discharging portion 35 includes the plurality of openings 35*a* shifted and disposed along the direction (arrow F direction) perpendicular to the unsealing direction (arrow E direction) in which the exposure of the openings 35*a* is advanced. For that reason, also the portion connecting portions 35*b* defining the plurality of openings 35*a* are disposed along the arrow F direction. As a result, the portion connecting portions 35*b* connect the first bonding portion 22*a* and the second bonding portion 22*b* with respect to the unsealing direction (arrow E direction) of the openings 35*a*. For that reason, at the time of the state of (a) of FIG. 8 in which the unsealing of the first bonding portion 22*a* is ended, the force for unsealing the second bonding portion 22*b* can be received by the first fixing portion 16*d* via the connecting portions 35*b*, so that the force for peeling off the sealing member 19 from the developer accommodating member 16 can be transferred. That is, the forces are applied to the second bonding portion 22*b* in the arrow D direction and the arrow E direction, so that also at the second bonding portion 22*b*, the sealing member 19 is peelable.

A similar effect can be obtained also in cases other than the case where the openings 35*a* are arranged in the direction (arrow F direction) perpendicular to the unsealing direction (arrow E direction) as shown in (b) of FIG. 28 as described above. Even when the openings 35*a* are not completely arranged in the direction perpendicular to the unsealing direction (arrow E direction) as shown in (c) of FIG. 28, the connecting portions 35*b* can transmit the force, for peeling off the sealing member 19 from the developer accommodating member 16, in an arrow P direction. Further, even when the openings 35 overlap each other with respect to the unsealing direction (arrow E direction) as shown in (d) of FIG. 28, the connecting portions 35*b* can transmit the force, for obliquely peeling the sealing member 19 from the developer accommodating member 16, in an arrow P direction. That is, the plurality of openings 35*a* may only be required to be shifted and disposed with respect to the arrow F direction perpendicular to the unsealing direction (arrow E direction).

Further, as shown in (b) of FIG. 28, a portion including the connecting portions 35*b* provided at a periphery of the openings 35*a* may also be used as the bonding portion 22. Also in this case, by the presence of the connecting portions 35*b*, the force can be transmitted until the sealing member 19 is completely peeled off at the bonding portion 22, so that the unsealing is effected with reliability.

As for a relationship between the rotation shaft of the rotatable member 20 and the openings 35*a*, it can be said that the openings 35*a* are shifted and disposed in the direction (arrow F direction) of the rotation shaft of the rotatable member 20. As a result, the connecting portions 35*b* for connecting the first and second bonding portions 22*a* and 22*b* with respect to the direction (the arrow E direction) perpendicular to the rotation shaft of the urging member 20 is provided. The openings 35*a* may only be required to be shifted and disposed in the rotational axis direction (indicated by the arrow F) of the unsealing member. Even when the openings 35*a* overlap with each other with respect to the rotational axis direction (indicated by the arrow F) as shown in (b) of FIG. 28 and do not overlap with each other completely with respect to the rotational axis direction (indicated by the arrow F) as shown in (d) of FIG. 28, the force can be transmitted in the arrow P direction and thus the effect of the connecting portions 35*b* can be achieved.

Thus, by the presence of the connecting portions 35*b* for connecting the first and second bonding portions 22*a* and 22*b* at the discharging portion 35, the developer accommodating member 16 accommodating the developer can transmit the unsealing force of the rotatable member 20 until the second bonding portion 22*b* is unsealed, so that the discharging portion 35 can be unsealed with reliability.

A relationship between the openings 35*a* and the engaging portion 19*b* of the sealing member 19 will be described (FIG. 3). The engaging portion 19*b* is provided in an end side of the sealing member 19 with respect to the direction substantially perpendicular to the direction in which the plurality of openings 35*a* are arranged.

A relationship between the openings 35*a* and the rotatable member 20 will be described (FIG. 3). The rotatable member 20 is provided in an end side of the sealing member 19 with respect to the direction substantially perpendicular to the direction in which the plurality of openings 35*a* are arranged.

Also in such a constitution, it is possible to obtain the effect of transmitting the unsealing force of the rotatable member 20 by the connecting portions 35*b* until the second bonding portion 22*b* is unsealed.

(Example of Connecting Portions as Separate Member)

The connecting portions 35*b* defining the openings 35*a* may also be provided as a separate member (connecting members 16*f*) as shown in FIG. 21. In this case, a constitution in which a single long opening 116*a* elongated in the arrow F direction perpendicular to the unsealing direction (arrow E direction) and then the connecting members 16*f* as the separate member connecting both sides of the opening 116*a* along the unsealing direction (arrow E direction) are provided on the opening 16*a* is employed. At this time, the connecting members 16*f* are bonded in each of the first bonding portion 22*a* side and the second bonding portion 22*b* side of the opening 116*a* by adhesive bonding, welding or the like.

Also in the case where the developer accommodating member 16 is provided with the connecting members 16*f*, the sealing member 19 is folded back between the bonding portion 22 and the engaging portion 18*b* as described above and is wound around the rotatable member 20, so that the flexible container 16 is unsealable. By employing such a constitution, the connecting portions 35*b* defining the openings 35*a* in the case where the plurality of openings 35*a* are provided, and the connecting members 16*f* perform the same function. That is, the single long opening 116*a* is the same as the plurality of openings 35*a* by providing the connecting members 16*f*.

Therefore, when the sealing member 19 is peeled at the second bonding portion 22*b* after the unsealing of the first bonding portion 22*a* is ended, the force (arrow D direction) during the unsealing of the second bonding portion 22*b* by the rotatable member 20 can be received by the first fixing portion 16*d* via the connecting members 16*f* with respect to the arrow H direction. Thus, the force for peeling the sealing member 19 from the developer accommodating member 16 can be transmitted. That is, the forces are applied to the second bonding portion 22*b* in the arrow D direction and the arrow H direction, so that also the second bonding portion 22*b* is unsealable.

In this way, the single long opening 116*a* is combined with the connecting members 16*f* to form the plurality of openings 35*a*, so that it also becomes possible to increase the stiffness of only the connecting members 16*f*.

(Problem of Unsealing Property in Case of No Connecting Portion)

An example in which the present invention is not applied and thus it is difficult to unseal the developer accommodating member 16 will be described. This is the case where there are no connecting portions 35*b* and thus it becomes difficult to unseal the developer bag 16 as shown in FIGS. 13 and 14. Parts (a) and (b) of FIG. 13 show an example in which there are no connecting portions 35*b* and a single long opening 116*a* is provided. Part (a) of FIG. 13 shows a state before the peeling at the second bonding portion 22*b*, and (b) of FIG. 13 and FIG. 15 show a state when the sealing member 19 is peeled at the second bonding portion 22*b*. Parts (a) and (b) of FIG. 8 are enlarged sectional views of the openings 35*a* and their periphery in states before and after the sealing member 19 is peeled at the second bonding portion 22*b* in this embodiment, and (a) to (c) of FIG. 14 are sectional views of the opening 16*a* and its periphery in the case where there are no connecting portions 35*b* and thus it becomes difficult to unseal the developer bag 16.

In this case, a state in which the unsealing is advanced to the second bonding portion 22*b* is shown in (a) of FIG. 14, and from this state, the sealing member 19 is pulled and moved in the arrow D direction by further rotation of the rotatable member 20. Then, since there are no connecting portions 35*b*, the force from the first fixing portion 16*d* cannot be transmitted to the second bonding portion 22*b* side at the central portion of the opening 116*a*. For that reason, as shown in (b) of FIG. 14 and (b) of FIG. 13, a binding force of the fixing portion 18*a* of the frame to the second bonding portion 22*b* is eliminated, so that the opening 116*a* gradually opens largely in the arrow D direction. Further, the second bonding portion 22*b* is pulled by the sealing member 19, so that the opening 116*a* is deformed as shown in (c) of FIG. 14. In this case, a force acting on the second bonding portion 22*b* fails to provide the inclination peeling positional relationship as shown in FIG. 8 and causes the shearing peeling (approximately 0-degree peeling) by the deformation of the opening 16*a* as shown in (c) of FIG. 14, so that there is a need to apply a large force for the peeling. In addition, the supporting force of the first fixing force 16*d* cannot be transmitted to the second bonding portion 22*b* and therefore the second bonding portion 22*b* is pulled by the rotatable member 20 without causing the peeling of the sealing member 19 therefrom. For that reason, the opening 116*a* in the neighborhood of a longitudinal central portion of the second bonding portion 22*b* further opens largely, so that the second bonding portion 22*b* is wound about the rotatable member 20.

Incidentally, when a developer accommodating member is a rigid structure, there is no such a deformation, so that the sealing member is unsealable as in the conventional example. However, in the case of a constitution in which the developer is accommodated in a soft deformation bag-like member and an opening which is deformed during unsealing is unsealed, as described above, when there are no connecting portions 35*b*, it is difficult to effect the unsealing.

As described above, the sealing member 19 (toner seal) is made unsealable transmitting the driving force to the rotatable member 20 of the image forming apparatus 100 and thus there is no need for the user to peel off the toner seal, so that the developer accommodating unit 25 and the cartridge A can be simply and easily replaced and used. Further, the sealing member 19 after the unsealing is fixed to the rotatable member 20, so that the unsealing can be effected without demounting a waste material from the cartridge A.

<Summary of Urging Member and Developer Discharge)

(Urging Member)

As shown in FIGS. 16 and 17, the urging sheet 21 is mounted on a surface of the rotatable member 20 which is rectangular in cross section. To the rotatable member 20, the driving force is transmitted by the unshown driving means inside the apparatus main assembly B, and when the rotatable member 20 is rotated in the arrow C direction, the urging sheet 21 is rotated together with the rotatable member 20 in the arrow C direction. The urging sheet 21 is a flexible sheet formed of a material such as PET, PPS (polyphenylene sulfide) or polycarbonate, in a thickness of about 0.05-0.1 mm, and an end thereof projects to the outside of a circumscribed circle of the rotatable member 20. In this embodiment, on different surfaces of the rotatable member 20, the sealing member 19 and the urging sheet 21 are fixed but may also be fixed on the same surface of the rotatable member 20. In the following, features will be described.

The developer accommodating member 16 is disposed at a part of the inner wall surface (in the upper region of the frames 17 and 18). When the urging sheet 21 of the urging member 500 or the sealing member 19 urges the developer accommodating member 16 to increase the urging force acting on the developer accommodating member 16 against the frames 17 and 18, the developer accommodating member 16 is pressed against the frames 17 and 18 to be contracted. When the urging force of the urging member 500 toward the developer accommodating member 16 is weakened, the developer accommodating member 16 is rebounded by the frames 17 and 18 to be expanded. Thus, the developer accommodating member 16 becomes small by being pressed against the frames 17 and 18 and becomes large by being rebounded by the frames 17 and 18, so that the developer accommodating member 16 is efficiently contracted and expanded to facilitate the discharge of the developer G from the openings 35*a*.

The urging member 500 changes the position of the opening-containing side X by urging the developer accommodating member 16. This is because the developer G is discharged from a portion thereof at a periphery of the openings 35*a* and thus the change is position of the opening-containing side X most facilitates the discharge of the developer G.

The developer accommodating member 16 is formed so that a position between the plurality of surface portions is curved, and the urging member 500 urges the opening-containing side X. The developer G is discharged from the portion thereof at the periphery of the openings 35*a* and thus when the position of the opening-containing side X is changed, the urging of the opening-containing side X most facilitates the discharge of the developer G.

The urging member 500 is rotatable provided in the frames 17 and 18, and a distance from its rotation center to an outer edge thereof is different with respect to the circumferential direction when viewed from its cross section perpendicular to the rotation center thereof. Particularly, the cross-sectional shape of the rotatable member 20 is not a circle but may also be a polygon and this is also a point in that the distance from the rotation center to the outer edge is different with respect to the circumferential direction. Therefore, when the urging sheet 21 is rotated, the urging member 500 repeats such an operation that it pushes and pulls the developer accommodating member 16.

The urging member 500 (particularly the urging sheet 21 or the sealing member 19) is capable of stirring the developer G, inside the frames 17 and 18, discharged from the developer accommodating member 16 and then is capable of feeding the developer G toward the supplying roller 23 and the developing roller 13.

<Summary of Developer Discharge from Developer Accommodating Member (Bag)>

(Summary of Discharge from Before Unsealing to During Unseal)

First, the discharge of the developer from before the unsealing to the time of start of the unsealing will be described. As described above with reference to FIGS. 7 and 8, the sealing member 19 is pulled toward the power application point portion 20*a* (in the arrow D direction), and the developer accommodating member 16 is supported by the fixing portion 18*c*. For that reason, during unsealing, three places consisting of the power application point portion 20*a*, the fixing portion 18*c* of the frame and the place of the bonding portion 22 where the sealing member 19 is peeled are moved in a direction in which these three places are aligned in a rectilinear line in a cross section perpendicular to the rotation shaft of the rotatable member 20. Thus, the position of the openings 35*a* is changed between the time before the rotatable member 20 applies the force to the sealing member 19 to perform the unsealing operation and the time when the unsealing operation is started to unseal the first bonding portion 22*a*, so that stagnation of the developer in the neighborhood of the openings 35*a* can be prevented and thus a discharging property is good.

(Summary of Discharge after Unsealing/During Urging)

The openings 35*a* formed to open downward with respect to the vertical direction. Before image formation, a part of the sealing member 19 of the urging member 500 closes the openings 35*a*, and during the image formation, the part of the sealing member 19 opens the openings 35*a*. The openings 35*a* are formed to open downward, and therefore only by opening the openings 35*a* by the sealing member 19, the developer G is discharged from the developer accommodating member 16 by the gravitation. Thus, when the openings 35*a* of the developer accommodating member 16 are unsealed, the developer in the neighborhood of the openings 35*a* is readily discharged by the action of the gravitation of the developer itself and vibration of the developer accommodating member 16, and the like.

After the unsealing, when the rotatable member 20 is further rotated, also the urging sheet 21*b* for urging the developer accommodating member 16 fixed to the rotatable member 20 is rotated, so that the urging sheet 21 is wound about the rotatable member 20 by the developer accommodating member 16 as shown in FIG. 9. As shown in FIG. 16, the urging sheet 21 has elasticity and therefore is likely to be restored to an original shape, thus urging the developer accommodating member 16 in an arrow J direction. At this time, the developer accommodating member 16 is urged by the urging sheet 21 and is pressed against the second frame 18 via the toner, so that the entire developer accommodating member 16 is deformed. The developer accommodating member 16 is urged by the urging sheet 21 to be decreased in its inside volume.

Thus, by the decrease in inside volume of and the change in entire shape of the developer accommodating member 16, the developer inside the developer accommodating member 16 is stirred and as a result, the developer is readily discharged from the openings 35*a*. At this time, the developer accommodating member 16 is closed except for the openings 35*a* and thus there is no escape route except for the openings 35*a*, and therefore the discharging property from the openings 35*a* is high. By the discharging action as described above, the developer is readily discharged in the arrow I direction.

In the case, when the developer accommodating member 16 is contacted to and pressed against the second frame 18 at least at a part thereof, the developer accommodating member 16 is deformable.

By aligning the rotational axis direction of the developing roller 13 and the arrangement direction (arrow F direction) of the plurality of openings 35*a*, the developer can be easily supplied over the entire longitudinal direction of the developing roller 13 during the discharge without being localized.

When the developer accommodating unit 25 is mounted in the image forming apparatus 100, by providing the openings 35*a* so as to open toward the direction of gravitation, the developer discharging property can be improved.

Further, the urging sheet 21 provided in the frames 17 and 18 urges the developer accommodating member 16 so as to be pressed against the frame 18, so that the developer discharging property can be improved.

(Summary of Discharge/Developer Bag Shape Restoration)

As shown in FIG. 17, the rotatable member 20 is further rotated, so that the urging sheet 21*b* is separated from the developer accommodating member 16. At this time, the developer accommodating member 16 has flexibility and therefore is likely to be restored to the state before the urging by the weight of the developer (arrow K direction). Then, also the sealing member 19 is rotated and urges the developer accommodating member 16 toward the frame 18 as shown in FIG. 16, so that the developer accommodating member 16 is deformed to move the developer at a position other than the neighborhood of the openings 35*a* and thus the developer is discharged from the openings 35*a*.

(Summary of Discharge/Repetition of Urging and Restoration)

In the case where the developer immediately after the unsealing is accommodated in the developer accommodating member 16 in a large amount, a penetration depth (entering amount) of the urging sheet 21, the sealing member 19 and the rotatable member 20 with respect to the developer accommodating member 16 is repetitively changed, so that the developer accommodating member 16 is deformed so as to be pressed against the frame 18. Contraction of the developer accommodating member 16 by the urging with the urging member 21 and restoration of the shape of the developer accommodating member 16 by the weight of the developer inside the developer accommodating member 16 and by the flexibility of the developer accommodating member 16 are repeated. Further, by the above-described action, the developer accommodating member 16 itself is moved and therefore the developer accommodating member 16 is vibrated, so that the developer inside the developer accommodating member 16 is discharged from the openings 35*a* also by the vibration of the developer accommodating member 16. The urging sheet 21 is rotated and therefore is capable of repetitively urging the developer accommodating member 16.

(Example in which Developer Accommodating Member is Applied to Frame)

A portion 27 where the developer accommodating member 16 is urged against the frame 18 is as shown in FIG. 25, even in the case where a bonding portion 28 such as an adhesive or a double-side tape is provided and bonds the developer accommodating member 16 to the second frame 18, the urging sheet 21*b* can urge the developer accommodating member 16 to discharge the developer.

(Case where Amount of Developer is Small)

The case where the amount of the developer inside the developer accommodating member 16 is decreased by image formation will be described with reference to (a) and (b) of FIG. 32. Immediately after the unsealing, as shown in (a) of FIG. 32, while the urging sheet 21 contacts the developer accommodating member 16, a size (inside volume) of the developer accommodating member 16 is periodically changed. However, when the amount of the accommodated developer becomes small, as shown in (b) of FIG. 32, the weight of the developer becomes light, so that the flexible container 16 does not readily follow the urging sheet 21 and thus repeats periodical separation from and contact with the urging sheet 21 in some cases. For that reason, the size (inside volume) of the developer accommodating member 16 is not so changed. For that reason, a developer discharging effect by the change in inside volume of the developer accommodating member 16 is decreased but by the periodical contact between the developer accommodating member 16 and the urging sheet 21, the developer accommodating member 16 is vibrated and thus the developer can be discharged.

(Combined Use as Urging Sheet and Sealing Member)

A single part may be used as the urging sheet 21 and the sealing member 19 to have functions of these members. After the unsealing, the bonding portion 22 is separated from the developer accommodating member 16 and therefore an end of the sealing member 19 in the bonding portion 22 side is a free end. For this reason, the sealing member 19 can have the function of the urging sheet 21. Thus, the rotatable member 20 can have the function of the rotatable member 20 for the urging sheet 21, and the sealing member 19 can have the function of the urging sheet 21. As a result, it is possible to reduce the number of parts and thus cost reduction can be realized.

As described above, the developer inside the developer accommodating member 16 can be satisfactorily discharged without providing another discharging part such as a developer discharging roller at the openings 35*a* as a developer discharging port, so that agglomeration and bridge of the developer in the neighborhood of the openings 35*a* can be prevented. As a result, even in the case where the developer in the developer accommodating member 16 is agglomerated by tapping during transportation, storage or the like, the agglomerated developer is broken by the movement of the entire developer accommodating member 16 and the periphery of the openings 35*a* as described above, so that it is possible to prevent a state in which it is difficult to discharge the developer.

Further, even when the rotatable member 20 is disposed in the immediate neighborhood of the developer accommodating member 16, the stiffness of the opening-containing side X is increased, and therefore not all the loads due to the flexure of the opening-containing side X by the weight of the developer filled in the developer accommodating member 16 are exerted on the rotatable member 20. As a result, the rotatable member 20 and the developer accommodating member 16 can be disposed close to each other, and therefore the developer accommodating unit 25 can be lowered with respect to the vertical direction and thus the process cartridge can be downsized.

(Example of Single Part for Urging Member)

The urging sheet 21 is not constituted by separate parts consisting of the rotatable member 20 and the urging sheet 21 but may also be constituted by a single part, as shown in (a) of FIG. 26, prepared by providing the urging sheet 21 integrally with a projection 21*c* functioning as the urging sheet 21. Also in this case, similarly, the developer can be discharged. In the case where the urging sheet 21 is constituted by only the rotatable member 20, when the urging sheet 21 is viewed in its cross section perpendicular to its rotation center, the cross section of the rotatable member 20 may have a polygonal shape ((b) of FIG. 26) or a cam shape ((c) of FIG. 26). Also, in this case, the developer accommodating member 16 can be pressed against a frame 29 to be deformed.

This is because when the urging sheet 21 is disposed so as to contact at least the developer accommodating member 16, a distance from the rotation center of the urging sheet 21 to the outer end of the urging member is changed and therefore the penetration depth of the urging sheet 21 with respect to the developer accommodating member 16 is also changed. That is, so long as the shaft portion (urging member) is not a shaft portion having a circular cross section including the rotation shaft as its center, the developer accommodating member 16 can be deformed by the rotation of the urging sheet 21. As shown in FIG. 20, a dimension of the projection 21*c* from the center of the urging sheet 21 to a remote outer end of the urging sheet 21 and a dimension 21*d* close to an outer end of the shaft portion are different from each other and therefore the penetration depth of the urging sheet 21 with respect to the developer accommodating member 16 is also changed.

Part (b) of FIG. 5 is a sectional view of an urging sheet 21 having a cross-shape in cross section, and (a) of FIG. 5 is a cross-sectional illustration of the developer accommodating unit 25 including the cross-shaped urging sheet 21. As shown in FIG. 5, in the case where four projections 21*e* each having the same distance from the center of the urging member 21 to an associated outer end are provided, outer configurations (21*c*) of the four projections 21*e* are the same. However, the urging member 21 includes a portion, other than the projections 21*e*, having an outer end (dimension 21*d*) close to the center and therefore the penetration depth with respect to the developer accommodating member 16 can be changed. That is, the urging sheet 21 can be constituted as a rotatable member including portions different in distance from its rotation center to its outer end in the cross section perpendicular to the rotation center of the urging sheet 21.

Thus, the developer accommodating member 16 is urged by the urging sheet 21 (in the arrow J direction) to be pressed against the frame 29, thus being deformed to decrease its inside volume, so that the inside developer is pushed out to be discharged from the openings 35*a* (arrow I direction).

In an attitude during the image formation, the rotatable member 20 of the urging sheet 21 is positioned under the developer accommodating member 16 in contact with the developer accommodating member 16 with respect to the direction of gravitation. The cross-sectional shape of the rotatable member 20 of the urging sheet 21 is rectangular not is not circular and therefore by the rotation of the rotatable member 20, the penetration depth of the rotatable member 20 with respect to the developer accommodating member 16 is periodically changed as described above. Also by the change in penetration depth of the rotatable member 20 with respect to the developer accommodating member 16, the developer accommodating member 16 can be changed in volume and can be vibrated, so that the developer discharging property can be improved.

Embodiment 2

Parts (a) to (c) of FIG. 19 are sectional views for illustrating a structure of a developer accommodating unit 25 in this embodiment. Constituent elements (members), of the developer accommodating unit 25 in this embodiment, having the same constitutions and effects as those of the developer accommodating unit 25 in Embodiment 1 are represented by the same reference numerals or symbols and will be appropriately omitted from description. Also in this embodiment, the developer accommodating unit 25 can be applied to the image forming apparatus similar to that in Embodiment 1, and therefore the explanation of the image forming apparatus will be omitted. The developer accommodating unit 25 in this embodiment is characterized in that the side on which the self-weight of the developer is exerted is not limited to the lower side with respect to the vertical direction. That is, in Embodiment 1, the self-weight of the developer is exerted toward the lower side with respect to the vertical direction, but in this embodiment, as shown in (b) of FIG. 19, the developer accommodating member 16 is flexed in an arrow K.

Part (a) of FIG. 19 shows a state in which the developer G is not present in the developer accommodating member 16. In (b) of FIG. 19, a positional relationship between the developer accommodating member 16 and the rotatable member 20 is such that the self-weight of the developer G is exerted in the arrow K direction when the developer G is filled, and thus the developer accommodating member 16 is flexed toward the rotatable member 20, so that the rotatable member 20 provided in the neighborhood of the developer accommodating member 16 enters (urges) the developer accommodating member 16. In this case, with respect to the rotatable member 20, an excessive torque is generated. Therefore, as shown in (c) of FIG. 19, in a side where the urging sheet 21 of the rotatable member 20 contacts the developer accommodating member 16, a bent-shaped portion U (continuously connected uneven shape) is provided so as not to establish a positional relationship as shown in (b) of FIG. 19. That is, by providing the bent-shaped portion U, the positional relationship between the developer accommodating member 16 and the rotatable member 20 is set at a state in which the bent-shaped portion U and the rotatable member 20 are spaced.

As described above, by providing the plurality of sides defined by the bent portion not only at the lower portion with respect to the vertical direction but also in the side where the developer G receives the gravitation, the degree of flexure of the developer accommodating member 16 can be reduced.

According to the constitution of Embodiments 1 and 2 described above, the stiffness of the developer accommodating member 16 at a portion which receives the powder pressure of the developer G is increased, so that the degree of flexure of the developer accommodating member 16 by the self-weight of the developer G can be reduced. As a result, downsizing of the developing device and improvement inefficiency of discharging the developer G from the developer accommodating member 16 can be compatibly realized. Incidentally, the number of the plurality of sides as the opening-containing side X described above is principally two, but is not limited to this constitution, i.e., may also be a plurality of numbers of three or more.

According to the present invention, the stiffness of the flexible container at the portion which receives the power pressure of the developer is increased, so that the degree of flexure of the flexible container by the self-weight of the developer can be reduced. As a result, it is possible to compatibly realize the downsizing of the developing device and the improvement in developer discharging efficiency from the flexible container.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 123634/2012 filed May 30, 2012, which is hereby incorporated by reference.

What is claimed is:

1. A developer accommodating unit comprising:

a flexible container, provided with an opening for permitting discharge of a developer, for accommodating the developer;

a frame for accommodating said flexible container and for accommodating the developer discharged from said flexible container; and an urging member, provided inside said frame, for urging said flexible container to deform said flexible container, wherein said flexible container has a plurality of sides divided by a bent portion, with developer existing on the plurality of sides and the bent portion, and wherein the sides are capable of receiving an urging force of said urging member.

2. A developer accommodating unit according to claim 1, wherein the opening is provided below the bent portion with respect to a vertical direction, and wherein the sides have a larger degree of inclination with respect to a direction of gravitation with a position closer to the opening.

3. A developer accommodating unit according to claim 1, wherein the sides are formed in an uneven shape continuously connected to the opening.

4. A developer accommodating unit according to claim 1, wherein said urging member changes a position of the sides of said flexible container by urging said flexible container.

5. A developer accommodating unit according to claim 1, wherein said flexible container is provided with a plurality of openings.

6. A developer accommodating unit according to claim 1, wherein the opening is open downward with respect to a vertical direction, and wherein a part of said urging member closes the opening before image formation and opens the opening during the image formation.

7. A developer accommodating unit according to claim 1, wherein said urging member is rotatably provided inside said frame, and wherein a distance from a rotation center of said urging member to an outer edge of said urging member is different with respect to a circumferential direction when viewed in cross section perpendicular to the rotation center of said urging member.

8. A developer accommodating unit according to claim 1, wherein said urging member includes an urging sheet for urging said flexible container, a sealing member for sealing the opening and for urging, after the opening is unsealed by rotation of said urging member, said flexible container and a rotatable member on which the urging sheet and the sealing member are to be fixed.

9. A developer accommodating unit according to claim 1, wherein said urging member is capable of stirring the developer, inside said frame, discharged from said flexible container.

10. A process cartridge detachably mountable with a main assembly of an image forming apparatus, comprising:

an electrophotographic photosensitive drum; and a developer accommodating unit, according to claim 1, integrally assembled with said electrophotographic photosensitive drum.

11. An electrophotographic image forming apparatus comprising:

a main assembly; and a process cartridge, according to claim 10, integrally assembled with said main assembly.

12. An image forming apparatus according to claim 11, further comprising:

a controller for controlling drive of said urging member, wherein said controller rotates said urging member to repetitively urge said flexible container.

13. A developer accommodating unit according to claim 1, wherein one of the plurality of sides has the opening.

14. A developer accommodating unit according to claim 1, wherein the opening is disposed below one of the plurality of sides.

15. A developer accommodating unit according to claim 1, wherein with respect to a phantom plane connecting remote ends of the sides from the bent portion, the bent portion is positioned in a side spaced from said urging member.

16. A developer accommodating unit according to claim 1, wherein said urging member is positioned on a phantom plane connecting remote ends of the sides from the bent portion.

* * * * *